United States Patent [19]

Mansfield

[11] 4,262,442

[45] Apr. 21, 1981

[54] CASTLE AND VILLAGE MAKING TOY

[76] Inventor: Robert Mansfield, 224 Woodlawn Terrace, Collingswood, N.J. 08108

[21] Appl. No.: 882,878

[22] Filed: Mar. 2, 1978

[51] Int. Cl.[3] ..... A63H 33/00

[52] U.S. Cl. ..... 46/16; 46/1 R; 425/DIG. 57

[58] Field of Search ..... 46/16, 1 R, 12; 425/DIG. 57; 249/119, 127, 129

[56] References Cited

U.S. PATENT DOCUMENTS

| | | | |
|---|---|---|---|
| 2,351,885 | 6/1944 | Sommerfeld | 46/30 X |
| 3,060,494 | 10/1962 | Noble | 249/119 X |
| 3,691,672 | 9/1972 | Pendill | 46/16 |

FOREIGN PATENT DOCUMENTS

| | | | |
|---|---|---|---|
| 1402024 | 12/1965 | France | 46/16 |
| 1316088 | 5/1973 | United Kingdom | 425/DIG. 57 |

*Primary Examiner*—Louis G. Mancene
*Assistant Examiner*—Mickey Yu
*Attorney, Agent, or Firm*—Robert E. Lee

[57] ABSTRACT

A tool for molding damp sand or other capillarily held insoluble granular material is disclosed. The tool is capable of forming a channel in a mound of material or removing a block of material from the mound. The disclosed mold of the preferred embodiment has flexible walls which can be moved back and forth to prevent adhesion of the granular materials to the walls of the mold and to facilitate easy removal of the mold.

9 Claims, 45 Drawing Figures

FIG. 1
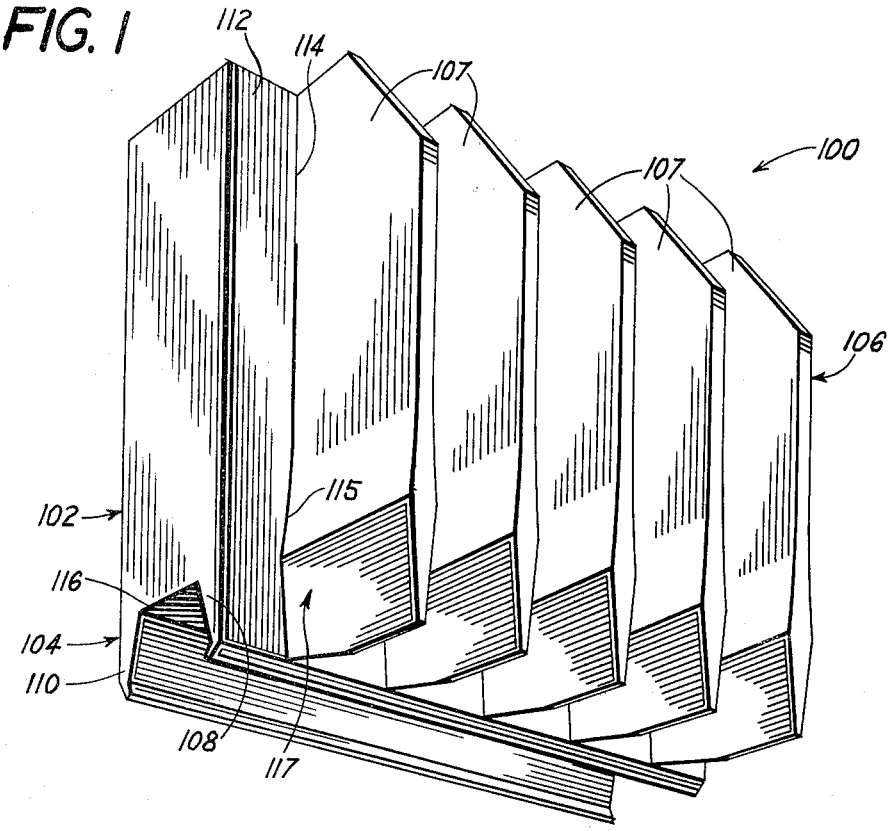
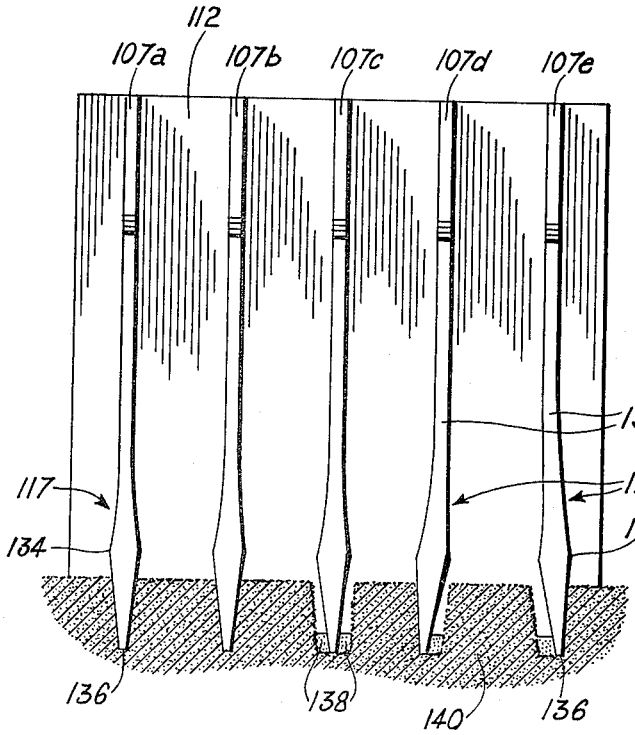
FIG. 2
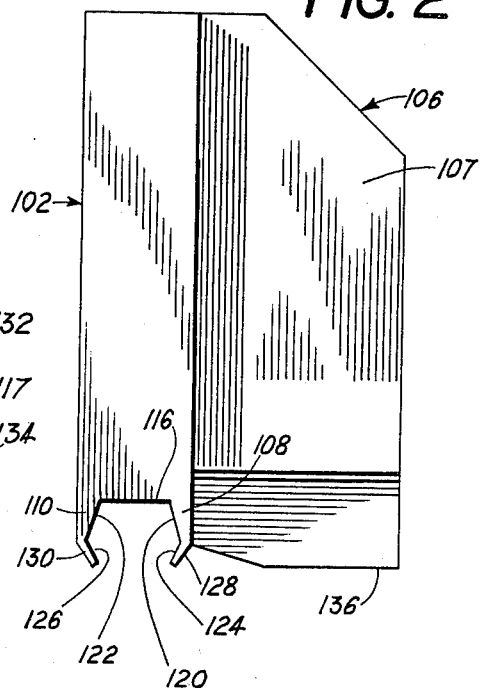
FIG. 3

FIG. 11
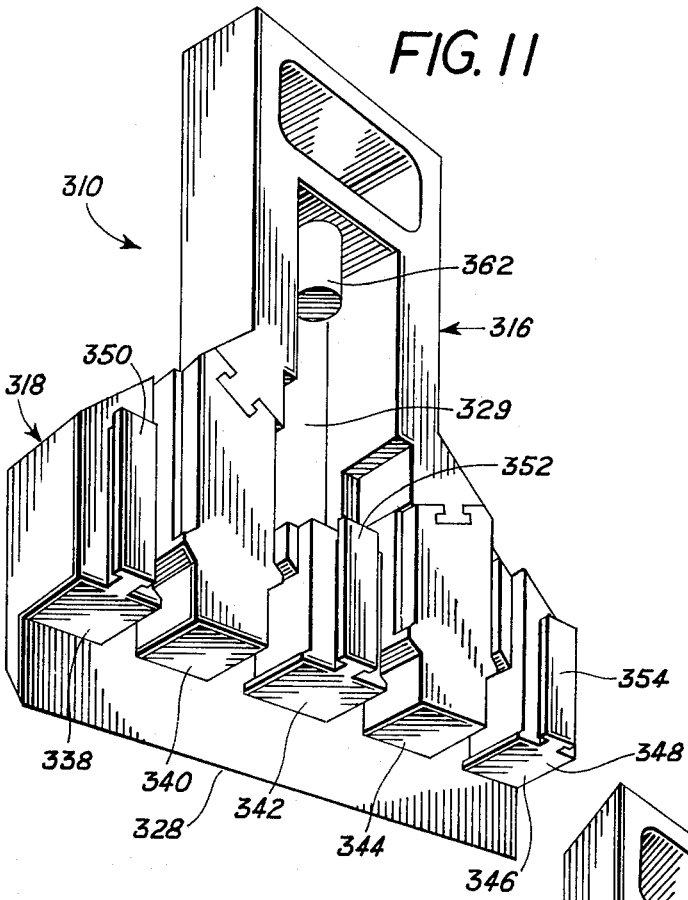
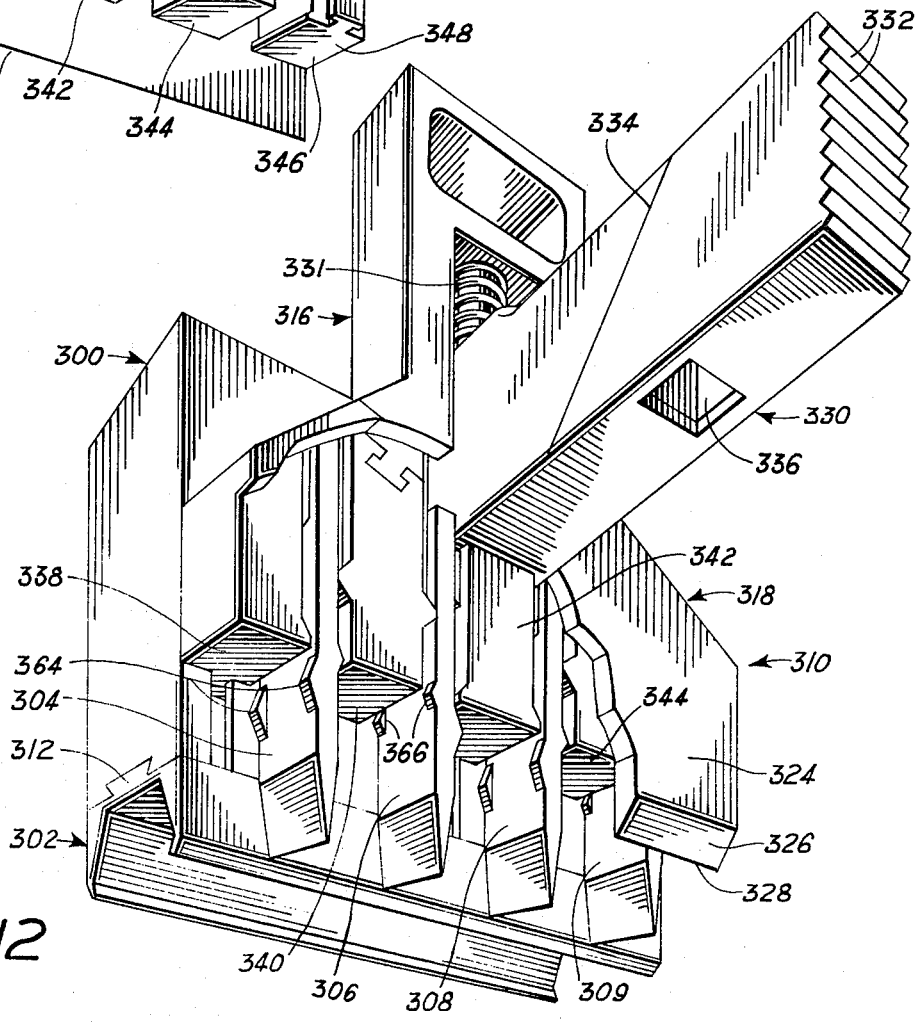
FIG. 12

FIG. 17
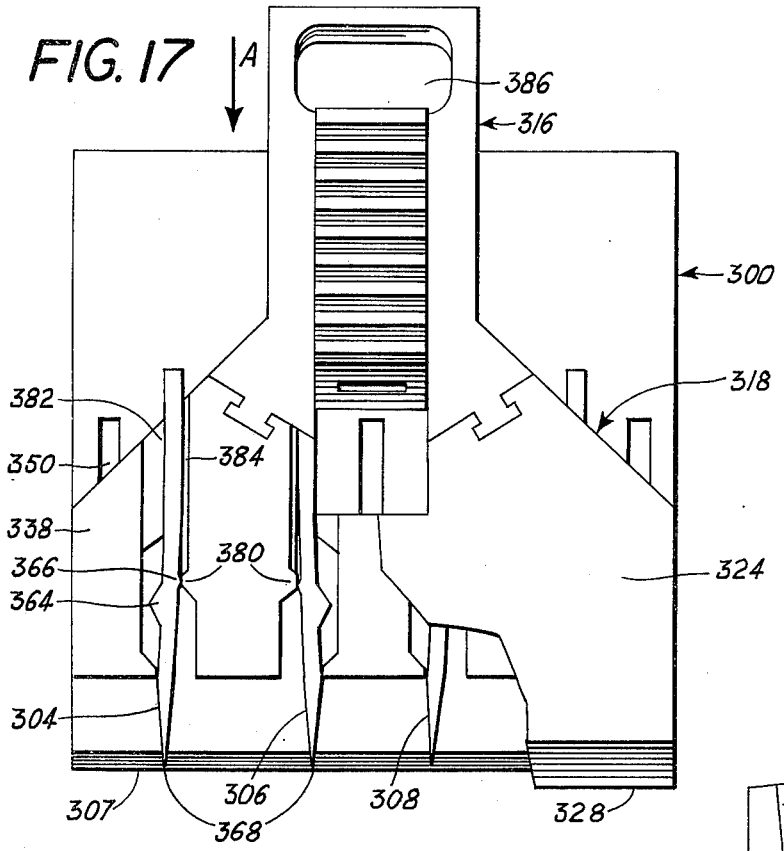
FIG. 18
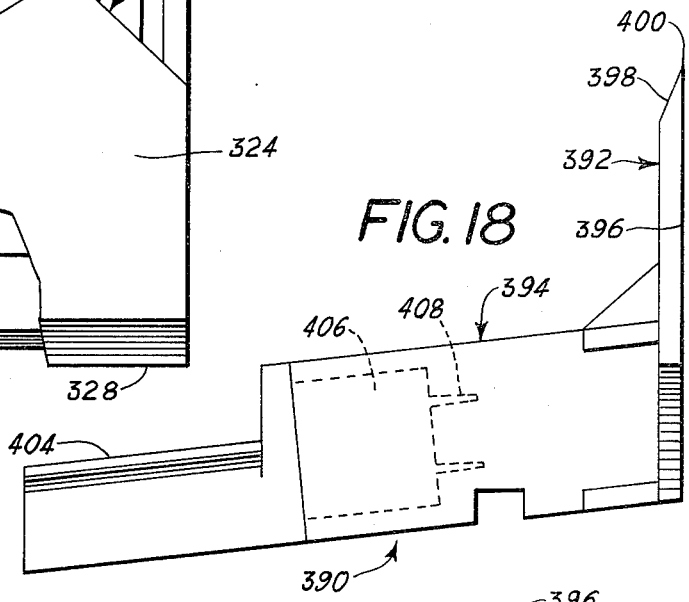
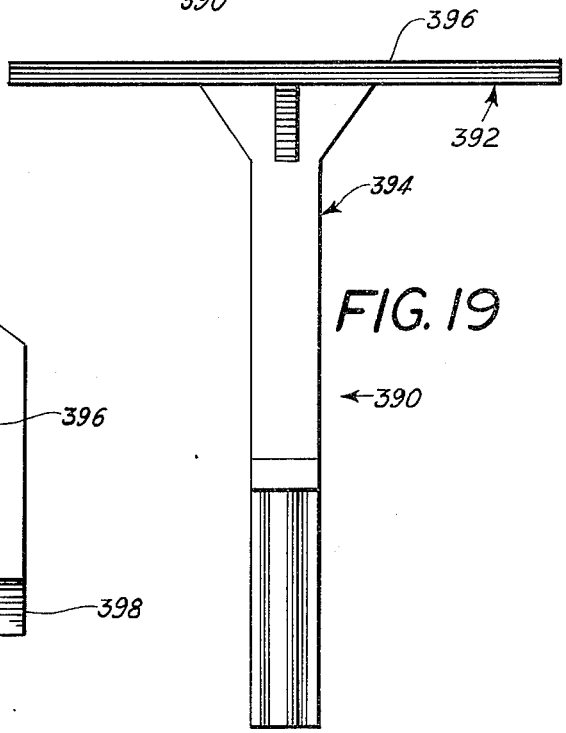
FIG. 19
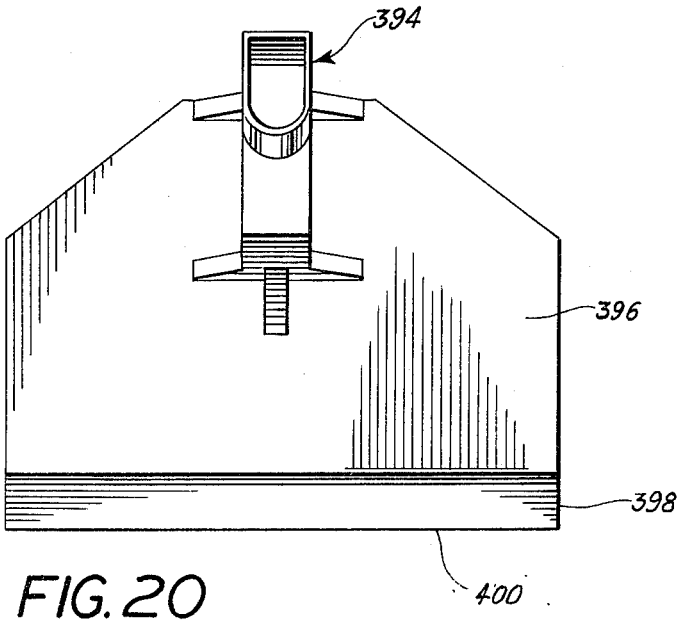
FIG. 20

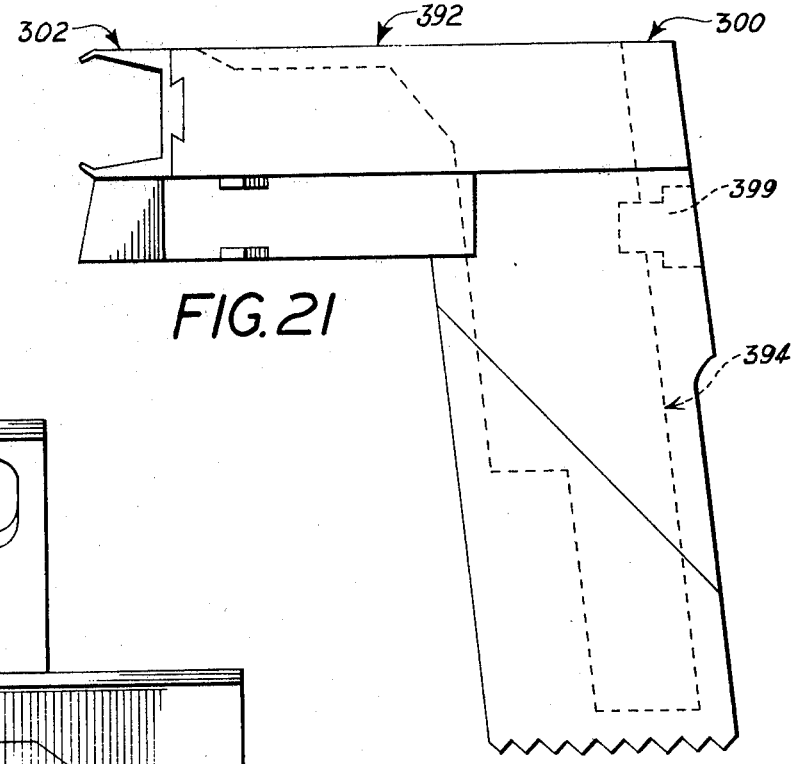
FIG. 21
FIG. 22
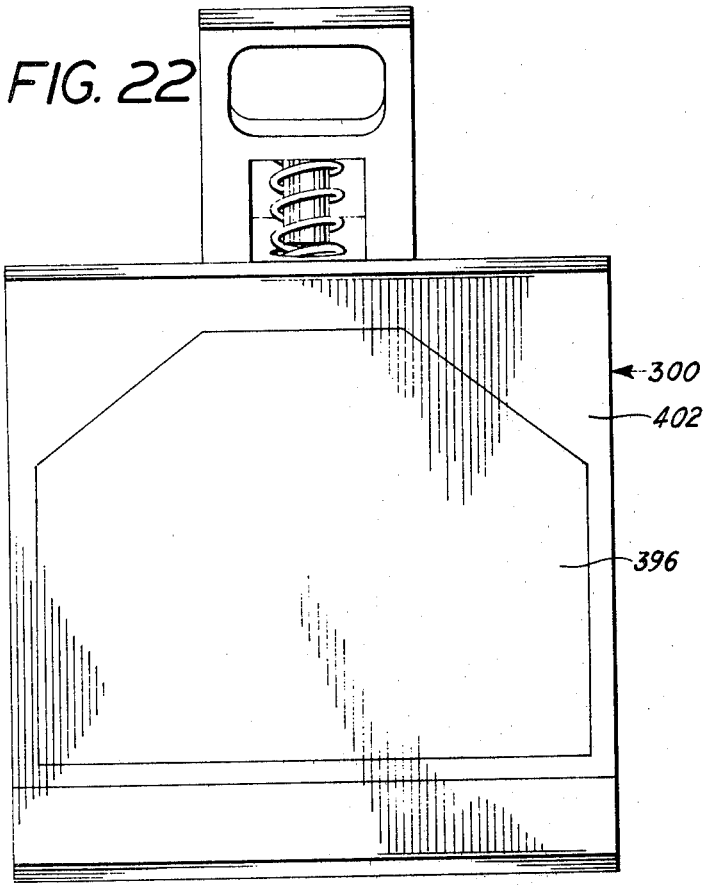
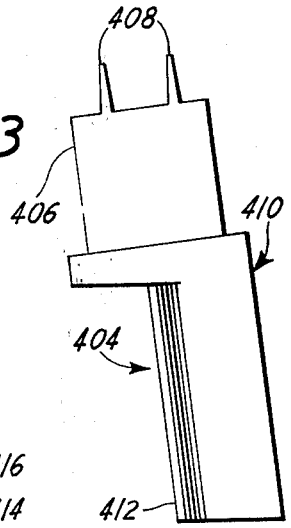
FIG. 23
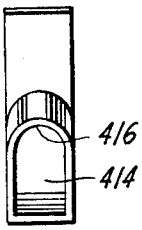
FIG. 24

FIG. 37
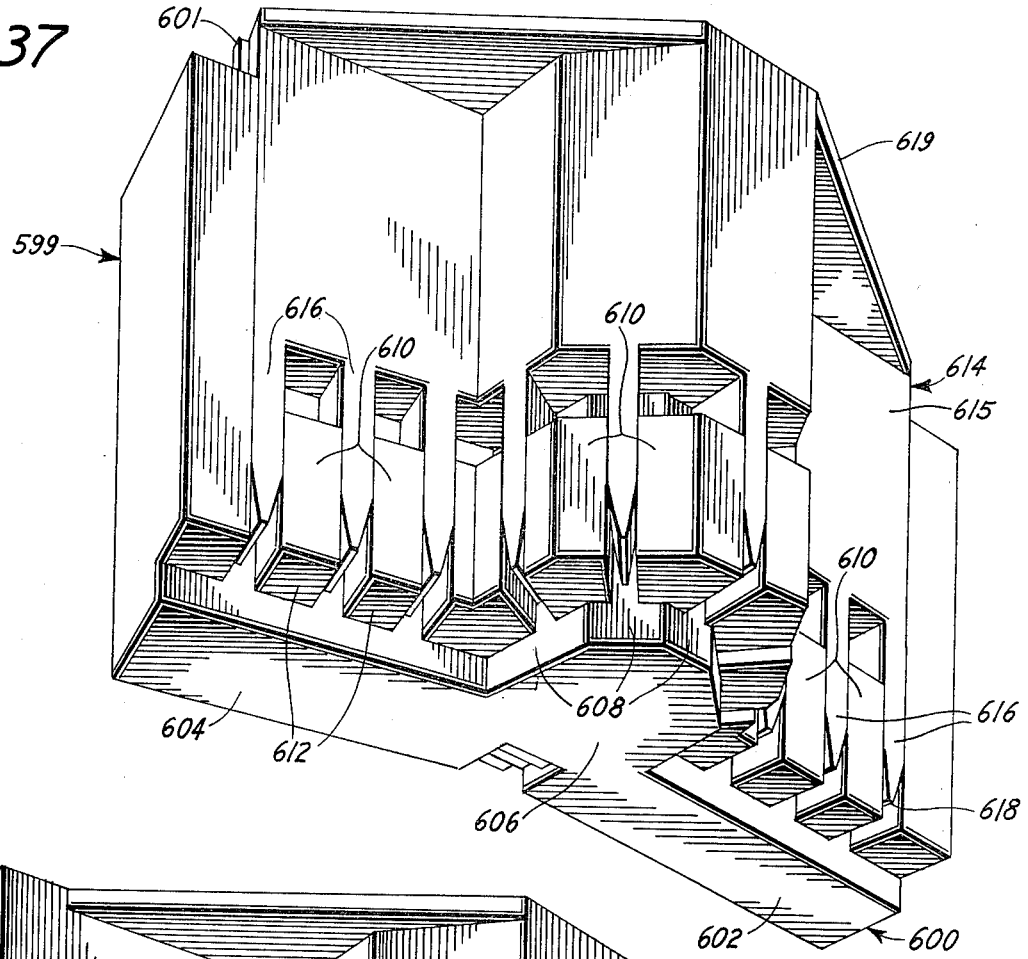
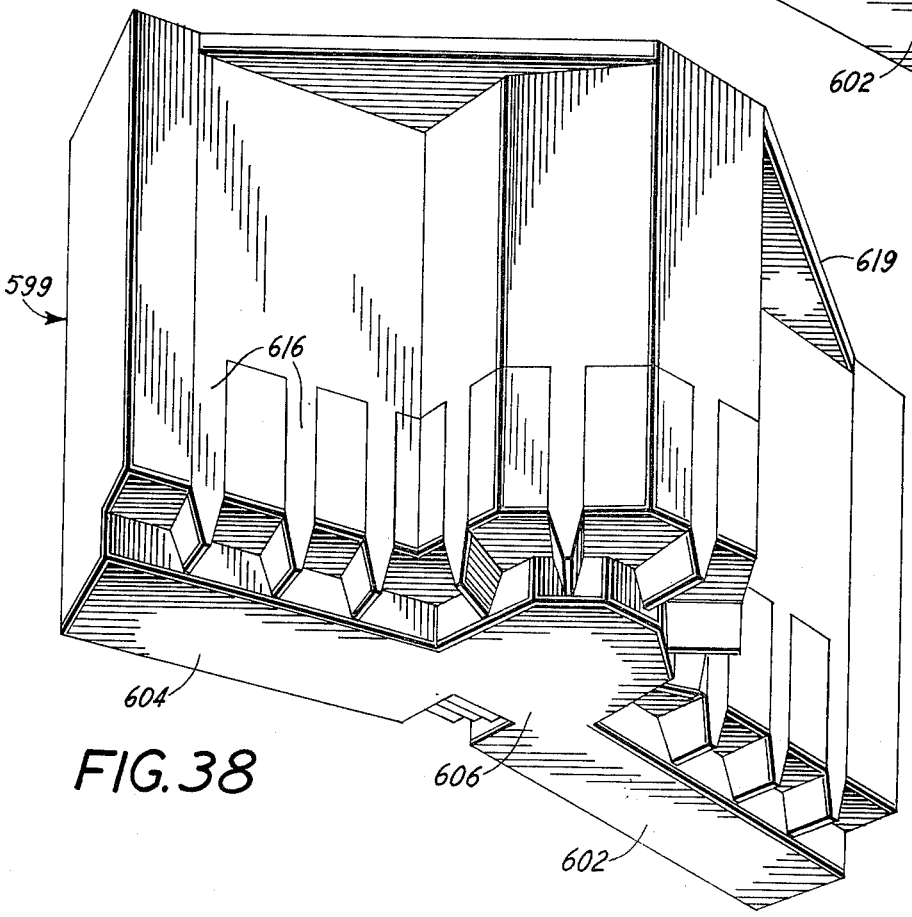
FIG. 38

FIG. 39
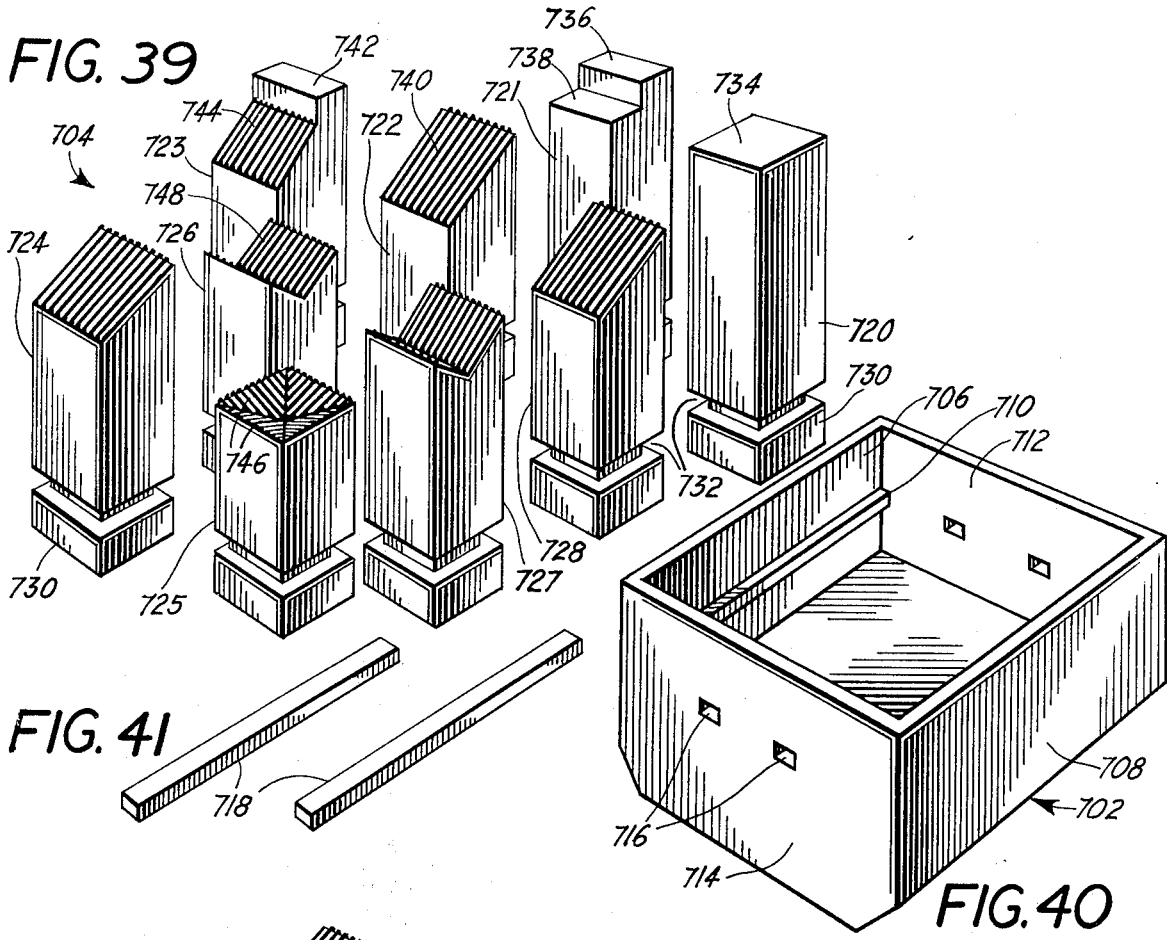
FIG. 41
FIG. 40
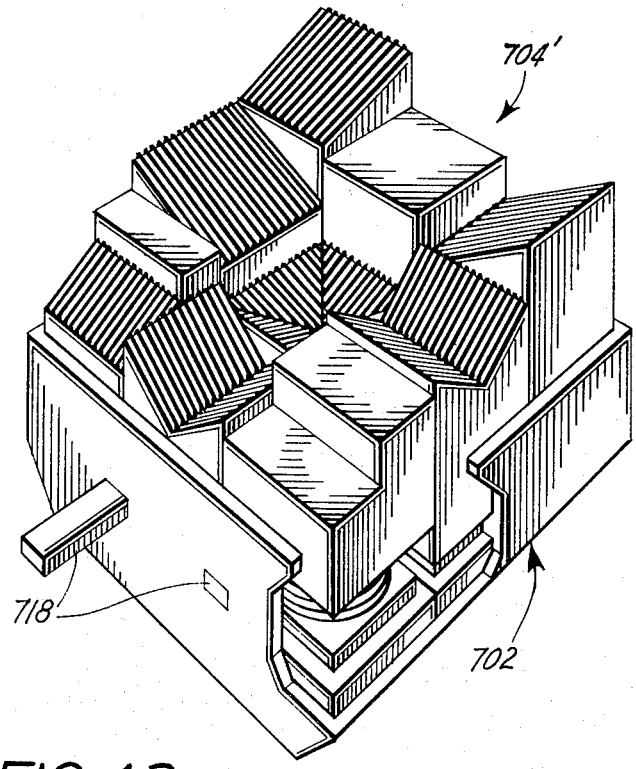
FIG. 42
FIG. 43
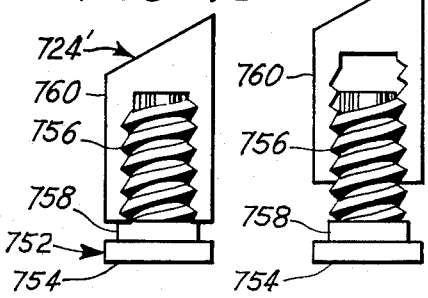
FIG. 44

CASTLE AND VILLAGE MAKING TOY

BACKGROUND OF THE INVENTION

This invention relates to an apparatus and method for forming castle battlements and villages in damp sand or other similar type material.

Small man-made mounds of sand often seen on the beach are commonly referred to as sand castles. They are usually made with utensils meant for other purposes, such as butter knives, spatulas, popsicle sticks, and empty cans. Forming castles with a modest amount of detail requires a skilled practitioner and an ample amount of time. Even then the castles are formed without battlements on the walls and towers of the castle which are perhaps its most outstanding features.

The battlements of such a castle comprise a parapet which is a breast-high wall of earth or stone which shields the castle troops from enemy fire. Notches or slots are formed in the parapet, often spaced apart evenly, called embrasures or crenelles. The portion of the parapet left between the crenelles are called merlons. The walkway behind the parapet is known as a banquette. When building battlements by hand, each merlon must be formed individually requiring great care to insure even spacings. Often, cracks in the sand and crumbling occurs when one attempts to form the banquettes, etc. by hand. Even when container-like molds are used, sand sticks in the corners of the mold and in small hollows meant to form the merlons. Consistently good battlements can not be constructed in this manner.

Constructing the walls and towers of sand is no problem for skilled and unskilled practitioners alike, but the addition of parapet walkways and battlements on those walls and towers is difficult because of the problems discussed above.

An example of the type of sand castle formed on beaches without the use of my invention is illustrated in a photograph appearing in the Tuesday, Sept. 6, 1977 Philadelphia Inquirer at page 2-B. The caption discloses that an 8 foot, 1 inch high castle was built in the sand. It included thirty-three floors, 1,637 windows, 84 doors and 752 stair steps. It took 17 hours to build.

Examples of molds for making battlement-like structures along with castle walls and towers is illustrated in French Pat. No. 1,402,024. FIG. 3 shows a container-like casting made from molds like those shown in FIGS. 1 and 2.

U.S. Pat. No. 2,351,885 (Summerfeld) describes a casting frame, cores for window openings, a detailed member of a building, a drawing or picture of the drawing, and the material for casting. Here, the structure to be cast is made up within a casting frame by placing casting parts or cores over appropriate parts of the drawing. Then the casting material is added.

Besides castles and battlements, other buildings and structures could be modeled in miniature in damp sand. However, villages such as feudal European farming villages were built in clusters with buildings made close together having common walls. The buildings or structures were rarely uniform in shape or design. Creating such fine detail to give a village effect in damp sand would require practiced skill and a great deal of time.

SUMMARY OF THE INVENTION

Applicant discloses an invention for making castle battlements and miniature villages in damp sand or other suitable material. The battlements include a wall known as a parapet having a plurality of spaced apart slots therein known as crenelles or embrasures. Adjacent to the parapet on one side is a channel in the sand which simulates a walkway known as a banquette.

In the preferred embodiments of applicant's invention, a tool having banquette means is disclosed for forming a channel in the sand. The banquette means comprises a channel portion formed adjacent to a side of the tool by extending opposite sides of the tool beyond the main body portion and the adjacent side. The tips of the walls are directed inwardly toward each other. The channel portion is pressed into a mound of damp sand which compresses into the channel. When the tool is withdrawn, the tip portions aid in withdrawing the sand within the channel portion with the tool leaving a channel behind in the sand. No cracks, crumbling or sticking occurs and the corners of the channel are straight with no sand adhering thereto. In the preferred embodiment, the tip portions are tapered to a cutting edge so that the tool cuts through the sand easily with little resistance until the sand fills the channel portion.

The tool also comprises crenelle means for making a plurality of spaced apart slots in the sand. The slots are directed along their lengths transverse to the axis of the channel left in the sand by the banquette means. In the preferred embodiment, the slots are periodically spaced apart, and, when oriented along straight wall sections, parallel.

The crenelle means comprises, in the preferred embodiment, a plurality of spaced apart blades. In the preferred embodiment, a portion of a longitudinal edge of each blade is connected to a side of the main body portion of the tool. The remaining portion of the blades, particularly the end portion which is adjacent a wall which forms the channel portion of the tool for making the banquette, is free to move back and forth since the blades are somewhat flexible and not attached to the side of the body portion at this point. When the tool is pressed in the sand, the plurality of blades presses through the sand to form slots therein. Before the tool is withdrawn, each of the end portions of the blades are moved back and forth along the wall portion of the channel. This breaks the adhesion of the sand from the sides of the blades and, when the tool is withdrawn, the blades leave the sand without any sand adhering to them.

Hence, a tool comprising a banquette means and crenelle means as described can be used to consistently, quickly and easily form a series of banquettes, portions of parapets and crenelles formed therein. No sand will be left in the corners of the channel and the slots will not be partially filled in with sand. The spacing is periodic and the overall appearance is that of a battlement in miniature.

In the preferred embodiment, each of the end portions of the blades are tapered to a cutting edge, the cutting edges of the blades being in a single plane with the cutting edges of the wall portions of the channel portion.

One embodiment of the tool comprises a rectangular sided, block-like body portion with the channel portion located at one side of the body portion. On a larger side of the body portion perpendicular to the side where the channel portion is located, there is located a plurality of parallel and evenly spaced apart blades.

Alternatively, the body portion of the tool is curved with two of the opposite sides being concentric with one another. These two sides are the sides which are extended to form the channel portion thereby providing a curved channel with an axis forming a portion of a circle. In another embodiment, the tool comprises a body portion whose cross-section is in the shape of polygons. The axes of the channel portions formed thereby are in the shape of a polygon. Each of the sides of the polygon have associated therewith a plurality of parallel and spaced apart blades which are attached to the body portion on an outwardly directing face of the body portion. The shaping of the channel and the functioning of the blades are similar to that described for the simple rectangular embodiment.

In another embodiment, a channel portion is located adjacent to a side of a simple rectangular body portion. Instead of the blades being attached to one side of the body portion, they are pivotable with respect to the channel portion and the body portion. When this tool is inserted into the sand, the blades press into the sand to form the slots. Before removing the tool, the blades are pivoted away from the channel portion through the sand thereby leaving a series of clean slots behind. In this embodiment, the top side of the tool is open so that a hand can be inserted therethrough and the plurality of blades are united along a common handle portion which is adapted to be engaged by the thumb and hand of the user manipulating the tool.

In still another embodiment, a channel portion is located at one side of a body portion of a simple rectangular design, and a plurality of spaced apart legs are attached to the opposite side of the body portion with each leg ending in a tapered cutting edge. After the channel has been formed in the sand by the channel portion, the other end of the tool is oriented to rake slots in the sand adjacent to the channel.

In each of the embodiments just described, it is necessary to finish the shape of the parapet wall by forming a longitudinal slot in the sand adjacent to a corresponding channel portion, but spaced away therefrom. A typical distance of spacing is a distance about equal to the width of the spaces between the blades which were used to form the crenelle slots in the sand ajdacent to the channel portion. The sand is then sheared away from the slot on the side of the slot remote from the crenelle slots and channel portion. This leaves behind a parapet wall of finite width having embrasures or crenelles therein and adjacent to a channel or banquette.

Another embodiment of applicant's invention is a toy for making castle battlements in damp sand, the battlements including banquettes, parapets and crenelles, the toy comprising in addition to the body portion with a plurality of sides, the banquette means for forming at least one channel in the sand and crenelle means for making a plurality of spaced apart slots or crenelles in the sand, a movable parapet means for forming parapets and for oscillating the crenelle means or blades during the formation of the parapet. In the preferred embodiment, the parapet means comprises a shuttle body which is in sliding engagement with the body portion of the toy. The toy is further equipped with a handle which is attached at one end to the body portion for easy manipulation of the toy by the user. The channel portion or banquette means is in sliding engagement with a side of the body portion.

In the preferred embodiment, the crenelle means comprises a plurality of spaced apart blades, a portion of each blade being attached to the side of the body portion with which the shuttle body is in sliding engagement. Only a portion of each blade is attached along the longitudinal edge leaving the remaining portion of the blade free to move back and forth along the wall portion of the banquette means or channel portion. This is similar to the blade description described earlier. The channel portion has the same function and shape as the banquette means described earlier.

The toy is inserted into a mound of sand with the channel portion filling with sand and the blades cutting into the sand adjacent to the channel portion. Then the shuttle body is moved down from a biased remote position and, as it does so, cams on a portion of the shuttle body to engage cams on either side of the blades to oscillate the blades back and forth. The shuttle body is equipped with a planar portion which is spaced apart from the side of the body portion by at least the width of the blades. The planar portion has a tapered longitudinal edge to form a cutting edge. When the shuttle body is pushed down against the action of the biasing means or spring to a forward position, this longitudinal edge slices the sand along a line which is parallel to the axis of the channel maker. When the pressure is withdrawn, the biasing means or spring automatically pulls the shuttle portion back to the remote position and, in so doing, oscillates the blades back and forth once again. A longitudinal slot then provides an easy way to scrape away the sand on a side of the slot remote from the channel portion. This is done in order to form a finite width to the parapet wall as was described before.

In order to avoid interference between the shuttle body and the handle portion, the shuttle body is equipped with a longitudinal track or opening which allows the shuttle body to move between remote and forward positions along the side of the body portion without contacting the handle portion. The handle portion passes through the track opening contacting the body portion.

At the end of the handle portion remote from the engagement or contact with the body portion, the handle is equipped with a plurality of spaced apart step-like grooves. These step-like grooves provide a function of maing step-like impressions in a mound of damp sand when this portion of the handle is pressed into the sand. Diagonal lines are positioned on either side of the handle portion and provide a guide for properly orienting these step-like grooves to form the appearance of a set of stairs. When the diagonal lines are oriented perpendicular to the horizontal, these step-like grooves in the end of the handle will provide a set of stairs in the damp sand.

In one embodiment of the toy, a hoe for finishing the wall is provided. The hoe has a planar blade portion with a tapered edge, and a handle portion which is adapted to be grasped by the nand of the user in manipulating the hoe. The hoe is adapted to snap into place within the toy with the planar portion sitting within a recess in one side of the body portion and with the handle portion of the hoe which is transverse to the planar portion extending across the body portion and into the handle of the toy.

An alternate embodiment of the toy just described above comprises a body portion; a banquette means; and a plurality of spaced apart blades in a manner similar to that just described. However, the blades of the alternate embodiment are not free to move from side to side. Instead, the sand is removed from adhesion to the side of the blades by a movable block which has a plurality of spaced apart slots therein. These spaced apart slots divide the movable block into a plurality of block portions, each block portion having a lower planar surface, all of the planar surfaces of the block portions being in a single plane. As the movable block is moved between a remote and forward position, the slots surround the immovable blades and the planar surfaces of the block portions push against the sand surrounding the blades. When the toy is first pressed into the mound of sand and the blades begin to cut into the sand, the sand pushes against the block portion moving it against a biasing means or spring. Then, as the toy is withdrawn, the spring pushes the movable block portion against the sand to eliminate any adhesion to the blades. This embodiment also can be equipped with a handle portion for easy manipulation.

Another embodiment of applicant's invention is a toy for making battlement merlons in damp sand or other capillarily held insoluble granular material. This toy or merlon maker comprises a body portion; a plurality of spaced apart cavities disposed in the body portion; a plurality of spaced apart blocks disposed in the cavities; and moving means for moving the blocks along the cavities; between remote and forward positions. The movable blocks have lower planar surfaces which are in a single plane in the preferred embodiment. The toy, if desired, can be equipped with a handle for easy manipulation by the user. The toy is gripped by the handle and raked into a mound of sand which fills the cavities and is compressed therein. Then the moving means is activated and the blocks move along the cavities to push the compressed sand out of the cavities. These blocks of compressed sand come out arrayed side by side to form merlons for a castle battlement.

The moving means in the preferred embodiment comprises a connecting rod which connects all of the blocks together. The connecting rod is pivotable about a pivoting axis. The connecting rod is activated by a lever arrangement and a trigger. When the trigger is pulled, the lever is pivoted about the pivoting axis and the connecting rod then moves along an arc to move all of the blocks together along the cavities.

Another embodiment of applicant's invention is a tower and side banquette embodiment which comprises a mold for making castles in damp sand, the castles having towers and walls with battlements on top of each. The mold comprises a tower means for forming the walls, banquette and parapets of the tower; side battlement means for forming side banquettes and parapets adjacent to opposite sides of the tower. In the preferred embodiment, the tower means comprises a tower wall portion and a tower banquette insert. The tower banquette insert has a first portion which engages the tower wall portions and has a remaining portion which is spaced apart from the tower wall portion. The tower wall portion has a plurality of spaced apart slots contained therein which align with a plurality of similarly-shaped grooves in the tower banquette insert. The tower can be formed by a plurality of sides which form a polygon or can be curved in the form of a circle.

In the preferred embodiment, the side battlement means comprises at least one side banquette insert which engages the tower wall portion and a side banquette wall which also engages the tower wall portion and is spaced apart from the insert. The side banquette walls have a plurality of spaced apart slots similar to the slots in the tower wall portions, and the side banquette inserts have a plurality of grooves similar in shape to the grooves in the tower banquette insert. The grooves in the side banquette inserts and the slots in the side banquette walls are in alignment.

In order to form the walls, tower and battlements, sand is pressed in behind the mold against the back side of the side banquette and tower wall portions. As the sand is pressed in, it is not free to move into the space occupied by the side banquette and tower banquette inserts. Sand is then deposited from above between the banquette inserts and the side and tower wall portions. This sand communicates with and engages the sand pressed in from behind.

The mold also comprises end walls which engage, or are connected to, the ends of the side battlement inserts and side walls remote from the tower means. A handle is connected to the end walls and to a portion of the tower wall portions.

Before the mold is withdrawn from the sand, the side banquette walls are flexed in and out to eliminate adhesion of the sand to the side walls. This is accomplished in the preferred embodiment by use of a threaded screw which matably engages a threaded portion in the handle. One end of the threaded screw is attached to the side banquette wall while the other end of the threaded screw passes through the threaded region in the handle to a head which is disposed on the opposite side of the handle from the side banquette walls. The head is adapted to be engaged by fingers of the user and rotated clockwise and counterclockwise thereby moving and flexing the side walls in and out. The side banquette walls and tower wall portions are made flexible just for this purpose.

The tower banquette insert is removable from the top of the tower means and the tower wall portions are flexible and can be squeezed to eliminate adhesion of the sand to the tower wall portions. The retaining means for holding the tower banquette insert in place comprises a bowed strip contained within a hollow portion of the tower banquette insert. The bowed strip, when partially flattened out, pushes its ends through slots in the tower banquette insert and through slots in the tower wall portions. The slots in the tower wall portions are disposed to align with the slots in the tower banquette insert.

The underside of the portion of the tower banquette insert has a plurality of step-like grooves contained thereon. These step-like grooves provide an impression of a set of stairs in the damp sand when it is packed into the back of the mold from behind.

In an alternate embodiment of the mold for making toy castle battlements in damp sand or other similar material, a mold is provided comprising a main body having a banquette surface for making banquette impressions in the sand. In the preferred embodiment, the impressions include a tower banquette and side banquettes disposed on either side. A plurality of spaced apart parapet blocks is connected to the main body, each of the blocks having a planar surface which are all in a single plane, parallel and spaced apart from the plane of the banquette surface in the preferred embodiment.

The mold further comprises a sliding member which is in sliding engagement with the main body and movable between the remote and forward position. The sliding member comprises a plurality of spaced apart blades which slide between the slots separating the blocks. First, the mold main body with the sliding member in a forward position is pressed into the sand to form banquettes and a portion of the parapet walls with slots therein. The banquette surfaces forms the banquette and the blocks planar surfaces form the top of the parapet wall while the blades on the sliding member form the slots. Then the sliding member is moved from the forward to a remote position. When finished, the mold is withdrawn from the damp sand.

Another embodiment of applicant's invention is a village maker for forming a toy village in a capillarily held insoluble granular material such as damp sand, the village maker comprising a retaining box; a plurality of village blocks for arraying in the retaining box, in any order; an aligning and retention means for holding the blocks in the box. In the preferred embodiment, each of the blocks has a square cross-section. However, the blocks are different lengths and have different end portions. For example, one end portion of a block comprises a plurality of parallel and spaced apart grooves all lying in a single plane, the single plane being transverse to the axis of the block. Another block comprises an end portion having a plurality of spaced apart planar surfaces, the planar surfaces being perpendicular to the axis of the block. Still, another block has a V-shaped end portion, each of the planes forming the V having a plurality of spaced apart and parallel grooves.

Each of the blocks has a base portion which is set off from the rest of the block by a groove which surrounds each block. When the blocks are positioned in the retaining box, the grooves are aligned and disposed to accept a retaining or holding bar which slips through apertures on opposite sides of the retaining box along the grooves of the blocks to align and hold them in place. Any number of blocks and any size retaining box could be provided for example, nine, twelve or sixteen or any number. Also, the shape of the retaining box in the preferred embodiment is square, but it could be any other shape, for example, blocks having a hexagonal cross-section could be used.

In an alternate embodiment of the village maker of applicant's invention, means are provided for varying the length of each of the blocks. For example, the base of each block could be attached to one end of a threaded shaft. The threaded shaft is matable with a threaded hole contained in the remaining portion of the block. When the base or block is rotated along the shaft, the distance of the end portion from the base can be varied.

Applicant discloses a method of making castle battlements in damp sand comprising the steps of forming a mound of sand; removing a block of sand or a plurality of blocks of sand from the mound of sand whereby channels are formed in the sand; making a plurality of slots in the mound of sand with the lengths of the slots being transverse to the channel and adjacent thereto; and removing a portion of the sand from the mound at a distance spaced apart from the channel and intersecting the plurality of slots. In the preferred embodiment, to carry out the step of making the plurality of slots adjacent to the channel, a plurality of spaced apart blades are provided and inserted into a mound of sand. The end portions of the blades are oscillated or moved back and forth along the channel to separate the sand from adhesion to the sides of the blades. Then the blades are removed from the sand.

Applicant also discloses a method of making a village in a mound of damp sand or other granular material comprising the steps of providing a plurality of blocks with different lengths. Each of the blocks has a different shape and textured end portion. The blocks are then arrayed and the end portions of the blocks of the array pressed into the damp sand, thereby creating an impression of contiguous roof tops in the sand. Thereafter the surrounding sand is removed to create the walls of houses. This creates a miniature village effect or impression in the sand.

It is an object of applicant's invention to provide a means for making castles in damp sand or other capillarily held insoluble granular material.

It is another object of applicant's invention to provide a means for making castles in damp sand or other suitable material that is consistent and easy.

It is still another object of applicant's invention to provide a means for making castles having battlements in damp sand or other suitable material.

Another object of applicant's invention is to provide a means for making castles having battlements in damp sand that is consistent and easy.

It is another object of application's invention to provide a means for making miniature villages in damp sand.

It is still another object of applicant's invention to provide a means for making miniature villages in damp sand that is quick and easy.

It is an object of applicant's invention to provide a method of making castles having battlements in damp sand or other suitable material.

It is still another object of applicant's invention to provide a method of making minature villages in damp sand that is quick and easy.

This and other objects of the present invention will become apparent from the following description with reference to the accompanying drawings.

BRIEF DESCRIPTION OF THE DRAWINGS

FIG. 1 is a perspective view of the preferred embodiment of applicant's battlement making tool;

FIG. 2 is a side elevational view of the tool of FIG. 1;

FIG. 3 is a front elevational view of the tool of FIG. 1 showing how the tool is used;

FIG. 11 is a perspective view of an opposite side of a first portion of the toy of FIG. 10;

FIG. 12 is a perspective view of the assembled toy of FIG. 10 with a portion broken away to show the interior of the toy;

FIG. 17 is an elevational view of the assembled toy of FIG. 12 showing a first portion in a forward position with a portion broken away to expose the interior of the toy;

FIG. 18 is a left side inverted elevational view of the hoe portion of applicant's toy;

FIG. 19 is a bottom view reoriented 180° of the hoe portion of FIG. 20;

FIG. 20 is a front elevational view of the hoe portion of FIG. 19;

FIG. 21 is a side elevational view of the assembled toy of FIG. 12 showing the hoe portion disposed therein in dotted lines;

FIG. 22 is a planar view of the assembled toy of FIG. 12;

FIG. 23 is a side elevational view of a window and doorway maker portion of the hoe portion of FIG. 18;

FIG. 24 is an end elevational view of the window and doorway maker of FIG. 23;

FIG. 37 is a perspective view of the preferred embodiment of applicant's battlement making mold with a portion in a remote position;

FIG. 38 is a perspective view of the mold of FIG. 37 with a portion in a forward position;

FIG. 39 is a perspective view of the preferred embodiment block portions of applicant's village maker;

FIG. 40 is a perspective view of the preferred embodiment retaining box of applicant's village maker;

FIG. 41 is a perspective view of the preferred embodiment holding bars of applicant's village maker;

FIG. 42 is a perspective view of the various portions of the village maker assembled together;

FIG. 43 is an elevational view of an alternate embodiment of applicant's block portion of a village maker showing a threaded shaft and threaded hole;

FIG. 44 is an elevational view of the block of FIG. 43 with a portion of the threaded shaft extended.

DETAILED DESCRIPTION OF THE DRAWINGS

Figure 4:
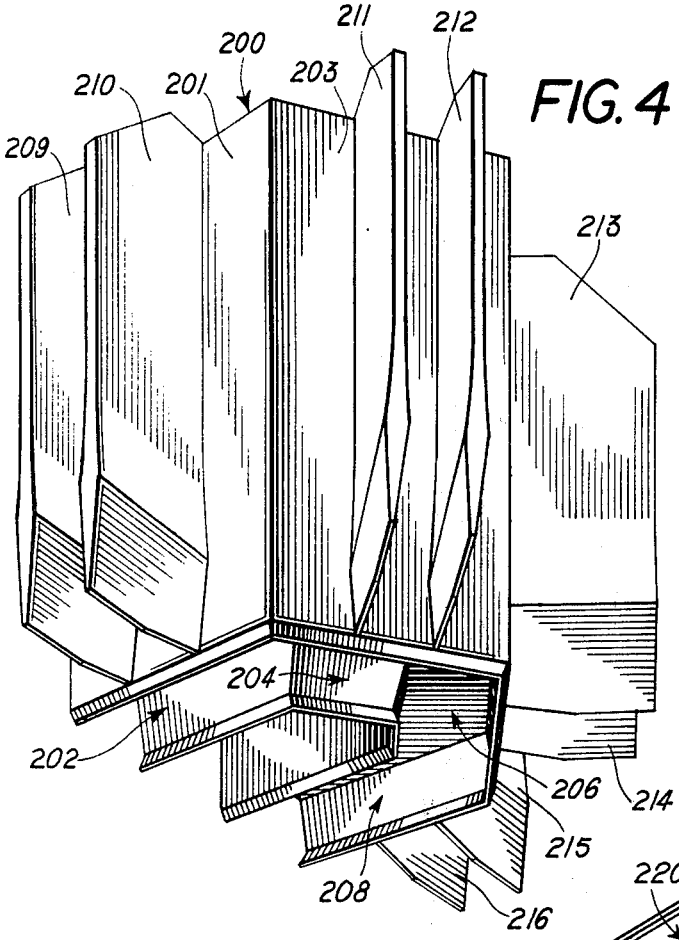
FIG. 4 is a perspective view of a first alternate embodiment of applicant's battlement making tool.

Although specific forms of the invention have been selected for illustration in the drawings, and the following description is drawn in specific terms for the purpose of describing these forms of the invention, this description is not intended to limit the scope of the invention which is defined in the appended claims.

Referring to FIG. 1, a perspective view of the preferred embodiment of applicant's tool is shown and designated generally 100. The tool comprises a body portion designated generally 102 having a plurality of sides; a banquette means for forming at least one channel in damp sand or other similar type material, the banquette means being located at a side of said body portion and designated generally 104; and crenelle means for making a plurality of spaced apart slots in the sand transverse to the axis of the channel designated generally 106. At least a portion of said crenelle means is connected to said body portion 102.

The banquette means comprises a channel portion formed by extending two opposite sides 108 and 110 of the body portion 102 beyond the third side 116 of the body portion 102. The wall portions 108 and 110 are shown spaced apart and generally parallel in the preferred embodiment of FIG. 1.

The crenelle means 106 comprises a plurality of parallel and spaced apart blades 107, each of which is connected to side 112 of the body portion 102 along a portion 114 (thin line) of a longitudinal edge of the blade. The remaining portion 115 (heavy line) of a longitudinal edge is adjacent but not attached to the side 112 allowing the lower part of the blade or end portion designated generally 117 which is adjacent to the wall portion 108 of the banquette means 104 to be oscillated or moved back and forth along the wall portion 108 of the banquette means 104. Although only one blade is so numbered in FIG. 1, each of the blades is connected in a similar manner.

FIG. 2, which is an end view of the tool of FIG. 1, shows the shape of the channel portion of the banquette means 104 more clearly. Each of the wall portions 108 and 110 have upper inner wall surfaces 120 and 122, respectively, which taper outward from one another, and lower inner wall surfaces 124 and 126, respectively, which taper inwardly toward one another. The upper inner wall surface is formed by tapering the thickness of the wall portion whereas the inner lower wall surfaces 124 and 126 are formed by tapering tip portions 128 and 130, respectively, of the wall portions themselves.

FIG. 3 is a side view of the tool of the preferred embodiment of applicant's invention along the outside longitudinal edges of the plurality of blades 107. The end portions 117 have a cross-sectional shape in the general form of a diamond. In the upper part of the end portion 117 where the straight portion 132 of the blade mates with the end portion 117, the width or thickness of the blades tapers outward until it reaches a point of maximum thickness at point 134. At this point, the thickness of the blade tapers inwardly until it reaches a cutting edge 136 along the bottom edge of the blades. The cutting edge 136 on each of the blades serves to part the granular material or damp sand 140 without a great deal of resistance. The tapering of the end portion from edge 136 to point 134 serves an additional purpose of giving a desired shape to the slot or crenelle which is left in the sand. The blades move along a slight arc as they are oscillated or moved back and forth along the wall portion of the channel portion of the tool. This would leave a wider slot at the bottom of the slot than at the top of the slot if it weren't for the tapered shape of the blade from the end portion 136 to the point 134.

The first two blades on the left in FIG. 3, 107*a* and 107*b*, are shown in a position after having just inserted the tool in the sand and without having oscillated the blade. The endmost blade on the right in FIG. 3, 107*e*, has been moved to the right to show how the slot begins to form. Next to the endmost blade on the right, is a blade 107*d* which has been moved only to the left in similar fashion to that of the endmost blade. The center blade 107*c* which is now in its normal position shows the shape of the slot after having moved the blade both to the right and to the left as the two endmost blades on the right demonstrate. Hence, a slot 138 which serves as the shape of a crenelle in a battlement is formed.

The tip portions 128 and 130 of the wall portions 108 and 110 of FIGS. 1 and 2 are tapered to form cutting edges. In the preferred embodiment, the cutting edges of the wall portions are in the same plane as the cutting edges 136 of the blades.

The preferred embodiment tool of FIGS. 1–3 has a body portion with a plurality of rectangular sides; all perpendicular to one another. The body portion serves to act as a handle for manipulation of the tool in the sand or other material. The wall portions 108 and 110 in the preferred embodiment extend from opposite parallel walls and are parallel and spaced apart themselves.

In the preferred embodiment of FIGS. 1–3, the tool is equipped with a plurality of parallel and spaced apart blades, the cutting edges 136 of the blades being perpendicular to the axis of the channel.

Applicant's invention discloses a method of forming castle battlements in damp sand or other capillarily held insoluable granular material. First a mound of damp sand or material is formed, a level area is prepared, and then a block of sand is removed from the mound of sand leaving a channel behind. It is important that in removing the block of sand from the remaining mound of sand, fissures or cracks in the remaining mound of sand are not formed. Before this is accomplished, slots are then formed adjacent to one side of the channel. This plurality of slots is generally parallel and spaced apart from one another and the length of the slots is transverse to the axis of the channel left behind. Finally, a portion of the sand or material is removed from the mound of sand, this material or sand being removed at a predetermined distance from the side wall of the channel. This removal of the sand is done on the same side of the channel where the slots are formed. This serves a purpose of creating a parapet wall having slots or crenelles formed therein adjacent or next to the channel portion. The channel portion, which was created in the sand serves as the banquette and together the banquette, parapet walls and crenelles form a battlement.

To insure that slots are formed in the sand without disturbing the sand inbetween the slots, a plurality of spaced apart blades can be provided for insertion into the sand adjacent to the channel. Each of the blades is then oscillated or moved back and forth along one wall of the channel to part the sand from adhesion to the side walls of the blades before removal of the blades from the mound of sand. Finally, the tool is removed from the mound of sand leaving behind slots or crenelles without disturbing the sand inbetween. The sand inbetween each of the slots serves as a merlon, a merlon being that portion of the parapet wall which stands between the slots in a battlement.

When the tool 100 is forced down into the mound of sand or material, the damp sand or material is forced into the channel portion of the banquette means 104. As the tool is forced further and further down, the material packs into the channel portion and presses up against the side 116 of the bottom portion 102. The side walls 108 and 110 and the side 116 are relatively immovable and the sand or material is compressed within the channel portion. When the tool is removed, the sand which has been compressed into the channel portion tends to behave as a solid block within the channel and the tapered portions 128 and 130 which tend to narrow the cross-section of the channel help to prevent the block of sand now within the recess from sliding out of the channel portion. The tapered ends of the tip portions 128 and 130 and the tapered edge 136 of the blades all form cutting edges which, in the preferred embodiment tool of FIGS. 1 through 3, are all in a single plane. As FIG. 2 shows, a portion of the cutting edge 136 of the blade 107 is tapered slightly out of plane toward the juncture of the tip portion 128 with the remaining portion of the wall portion 108.

FIG. 4 shows an alternate embodiment of the tool for making castle battlements comprising a body portion designated generally 200 having a plurality of sides such as sides 201 and 203 as well as others not shown. A plurality of pairs of wall portions extends from the body portion 200 to form a plurality of connected channel portions designated generally 202, 204, 206 and 208. The channel portions are each formed by a pair of spaced apart wall portions and a side of the body portion in a manner described before for FIG. 1. Each of the channel portions have associated with it a plurality of blades such as 209 and 210; 211 and 212; 213 and 214; and 215 and 216, respectively. These blades are located on various sides of the body portion 200 such as blades 209 and 210 on side 201, and blades 211 and 212 on side 203. The description of the relationship of the blades to the channel portions is the same as that discussed for FIGS. 1 through 3.

Figure 5:
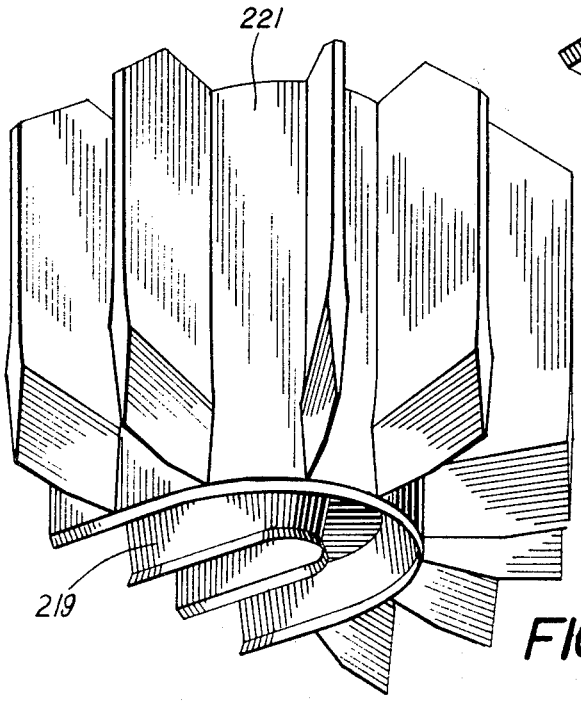
FIG. 5 is a perspective view of a second alternate embodiment of applicant's battlement making tool.

Each of the channels 202 through 208 have an axis which intersects the axis of the adjacent channel at an angle. The axes of the channels connect it together and this way form at least a portion of a polygon. In FIG. 4, the tool is drawn to show a battlement which would have four banquettes and four sides. However, a battlement with one, two, three or any number of sides could be formed. Similarly, as seen in FIG. 5, the battlement could have a curved banquette and the channel portion of the tool could be curved as in a portion of a circle. See the curved channel portion 219 of FIG. 5. The curved channel portion is formed by a pair of concentric wall portions extending from the body portion.

Referring once more to FIG. 4, each of the wall portions has a tip portion directed toward the tip portion of the remaining wall portion of the pair. In the embodiment in FIG. 4, the blades are connected to the body portion so that the end portions of the blade will be adjacent the channel portions along a wall portion of each channel portion which forms the outside of the polygon-shaped battlement such as wall portion extensions of walls 201 and 203. In the circular embodiment of FIG. 5, the blades are located on the convex surface 221 of the circular-shaped battlement. In the preferred embodiment, all wall tip portions and blade end portions are tapered to form cutting edges.

Figure 6:
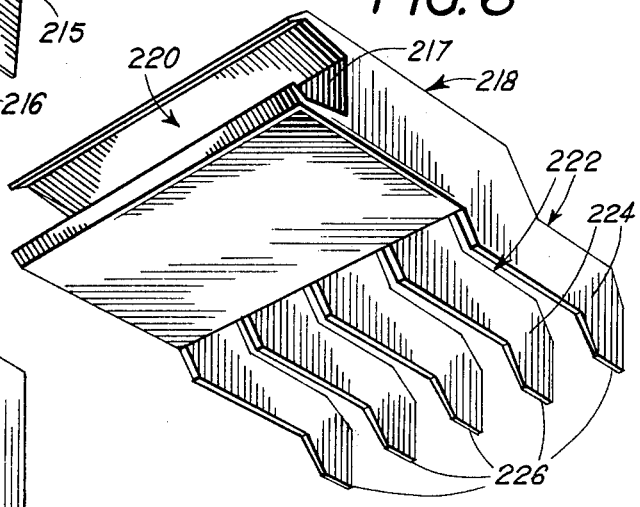
FIG. 6 is a perspective view of a third alternate embodiment of applicant's battlement making tool.

FIG. 6 shows an alternate embodiment of the tool having a body portion designated generally 218 and a channel portion designated generally 220. The channel portion and body portion are as described in FIGS. 1 through 3 and bear a similar relationship to one another. However, unlike FIGS. 1 through 3, the crenelle means for making slots in the damp sand adjacent and transverse of the channel portion comprises a plurality of spaced-apart planar legs designated generally 222 which are connected to the body portion 218 at a first end of the legs. The legs extend away from the body portion, each of the legs having a second end portion 224 which is transverse to the remainder of said leg. The edge of the end portions 224 are tapered to form a cutting edge 226. In the alternate embodiment of FIG. 6, the first ends of the plurality of legs are connected to a second side of the body portion 218, which is opposite from the first side 217 around which the channel portion 220 is formed.

The embodiment of FIG. 6 is grasped by the body portion 218 and inserted preferably downward into a leveled area on a mound of damp sand (or other similar type material) until the sand fills the channel portion 220 and is compressed against the wall portions and side 217. Then the tool is withdrawn and the sand within the cavity stays in the channel with the help of the inwardly-directed tip portions of the wall portions.

Next, the tool is turned around, grasped around the body portion and, with the end portions 224 directed downward, cutting edges 226 are raked through the mound of sand adjacent and transverse to the channel created in the sand by the channel portion 220 of the opposite side of the tool. The raking action creates slots which represent the crenelles in a parapet wall. However, the parapet wall has not yet been fully formed. To do this the sand must be sliced away from the mound at a preselected distance from and parallel to the channel created by the channel portion. The slice should be made to intersect the slots or occur at the ends thereof.

Figure 7:
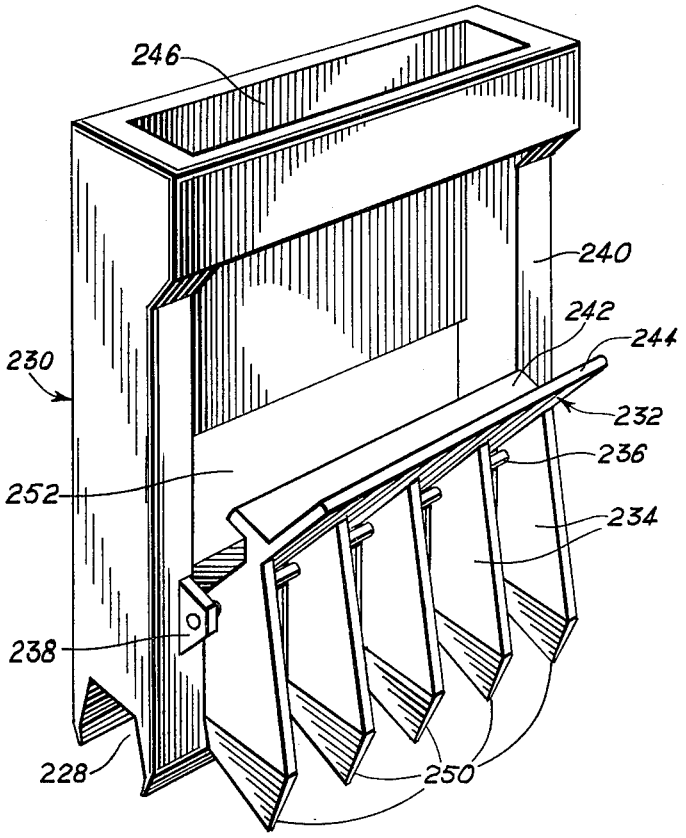
FIG. 7 is a perspective view of a fourth alternate embodiment of applicant's battlement making tool with a portion of said tool being pivotable.

FIG. 7 shows an alternate embodiment of the tool of applicant's invention for making castle battlements. A channel portion 228 is shown connected to a body portion designated generally 230 in a fashion similar to that described in FIGS. 1 through 3. Body portion 230 has an open end 246. However, the blades which form the crenelles in the damp sand or material adjacent to the channel 228 are pivotal away from the channel portion and the side of the body portion 230. This crenelle means for making slots in the sand adjacent to the channel portion comprises a handle portion designated generally 232 to which is connected a plurality of blades 234. The handle portion 232 comprises members 242 and 244 which are transverse to each other. The crenelle means is pivotal about an axle rod 236 which runs through each of the blades. The rod 236 is free to rotate through openings in brackets such as bracket 238 located on either end of side 240 of the body portion 230.

Figure 8:
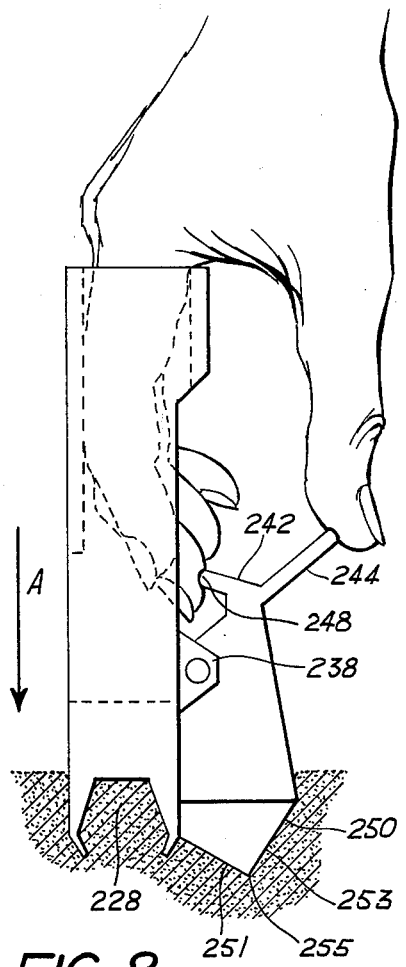
FIG. 8 is a side elevational view of the tool of FIG. 7 showing the position of a user's hand in manipulating the tool.
Figure 9:
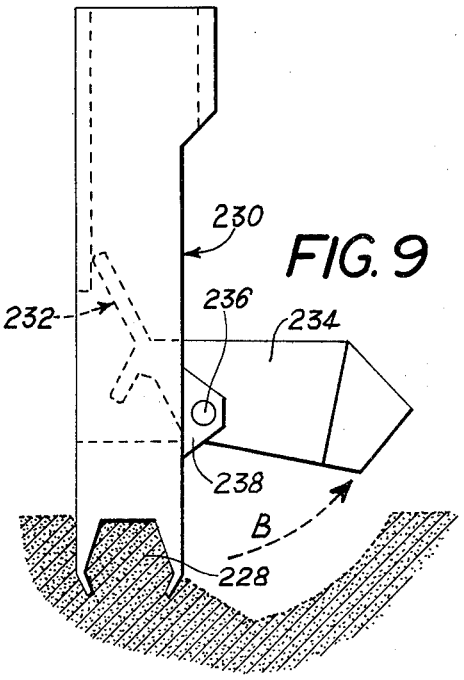
FIG. 9 is a side elevational view of the tool of FIG. 7 showing the pivotable portion in a remote position.

This tool is operated in the fashion shown in FIGS. 8 and 9. In order to insert the tool, the fingers of the user are inserted into the open top or open end 246 of the body portion 230. With the fingers grapsing the end 248 of member 242 and the thumb pushing down against the member 244, the tool is pushed down into the sand in a direction denoted by arrow A of FIG. 8. The sand is compressed into the cavity 228 and the cutting edge 250 of each of the blades cuts through the sand until the cavity 228 is filled. Now in order to remove the blades from the sand without disturbing the sand between each of the blades, the hand is removed from the tool and the lever 224 is pushed in toward the handle so that the blades will rotate in the direction shown by the dotted arrow B in FIG. 9. FIG. 9 shows the tool inserted into the sand with the blades rotated away from the channel portion 228. Hence, FIG. 9 shows the blade in a remote position after having withdrawn the hand from the tool, and FIG. 8 shows the blades in the forward position as it is inserted into the sand with the hand in place in the tool. In this way, the blades can be withdrawn from the sand without disrupting the sand or material located between each of the blades. This is necessary in order to create a smooth-looking parapet with crenelles or merlons in a battlement. The sand which is withdrawn with the channel portion 228 from the mound of sand leaves behind the banquette portion of the battlement. To finish off the parapet portion of the battlement, the sand is sliced off at a distance spaced apart from the wall portion of the channel by a distance which is about equal to the width between the blades. In order to allow the handle portion designated generally 232 to pivot with the blades 234, a portion of the side 240 of the body portion is left open. This portion is designated 252 in FIG. 7. It should be noted that the end portion of the blades of this embodiment represent an alternate embodiment to that shown in FIG. 2. For example, the cutting edge 250 of the blades 234 comprises two edges 251 and 253 transverse to one another ending in a point 255.

Figure 10:
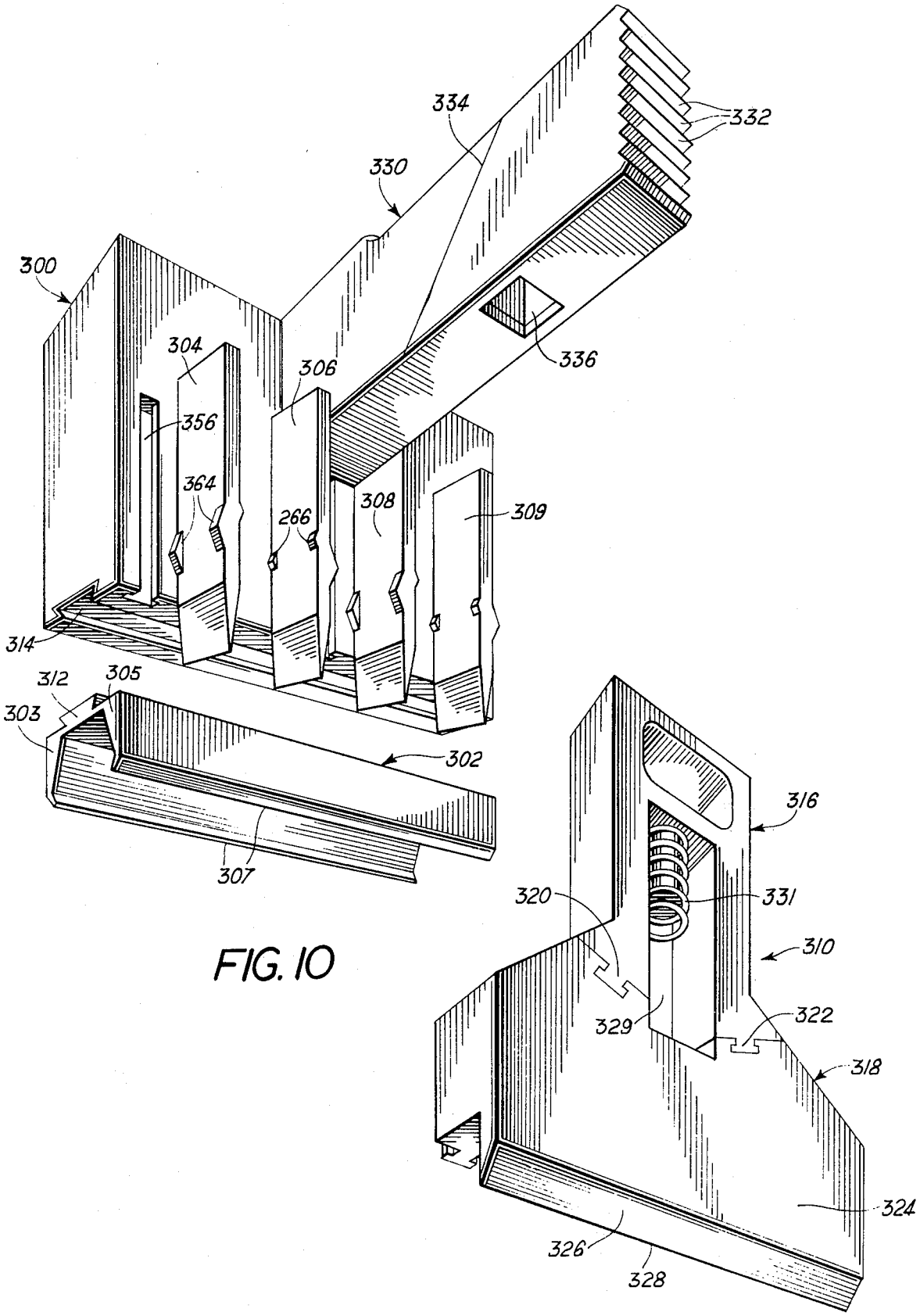
FIG. 10 is an exploded perspective view of the preferred embodiment of applicant's battlement making toy.

FIG. 10 is an exploded view of an embodiment of a toy for making castle battlements in a mound of damp sand or in other similar type material. Castle battlements typically include banquettes, parapets and crenelles. The preferred embodiment castle making toy comprises: a block-like body portion designated generally 300, the body portion having a plurality of sides; a banquette means for making a channel in a mound of damp sand or other material including a channel portion designated generally 302; crenelle means for making a plurality of spaced apart slots in the mound of sand or other material, the slots being adjacent and transverse to the axis of the channel left in the sand by the banquette means. The crenelle means including a plurality of blades 304, 306, 308 and 309 which are connected along at least a portion of their longitudinal edges to the body portion 300; and movable parapet means for forming parapets and oscillating the crennele means during formation of the parapets, the parapet means comprising a shuttle body designated generally 310 and being in sliding engagement with the body portion 300 and movable between a remote position and a forward position.

The channel portion is disposed to slidingly engage a side of the body portion 300. It has a tapered projection 312 which is matable with a tapered slot 314 on the side of the body portion 300. Thus, the channel portion 302 can be slid into the slot to attach to the body portion 300 for easy assembly.

The remaining characteristics of the channel portion 302 involving the wall portions 303 and 305 and cross-sectional shape of the channel are identical to the description of the channel portion 104 in FIGS. 1–3. Wall portions have inwardly directed tapered tip portions with cutting edges 307.

The shuttle body 310 comprises an upper portion designated generally 316 and a lower portion designated generally 318. The upper portion is equipped with T-shaped projections 320 and 322 which are disposed to fit within T-shaped slots in the lower portion to allow the upper portion to be slid into engagement thereto for easy assembly. The two pieces are shown connected in FIG. 10.

The shuttle is equipped with a planar portion 324 which has a tapered end portion 326 ending in a straight edge 328 along one entire side of the surface to form a cutting edge.

FIG. 10 also shows a handle designated generally 330 connected to a side of the body portion 300, namely, the side to which the blades 304–309 are connected. One end of the handle remote from the body portion 300 has a plurality of spaced apart step-like grooves 332 contained therein. A diagonal line 334 runs across two opposite sides of the handle and a third side contains a rectangular opening 336 opening into the interior of the handle 330. When the end of the handle is pressed into a mound of damp sand or other material, step-like impressions are made therein. The diagonal line serves as a guide for proper orientation of the steps, i.e., in the preferred embodiment when the line 334 is kept perpendicular, the step-like impression will be formed at a correct angle for forming a set of stairs. Of course, the line could be situated so that when placed horizontal, the steps will be at the right angle, or when the line is in some other orientation, the steps would be properly oriented.

In the preferred embodiment, upper portion 316 of the shuttle 310 has a long rectangular opening 329. When the shuttle body 310 is in engagement with the body portion 300, clearance must be allowed for the handle 330. The opening 329 is long to allow movement of the shuttle body 310 between remote and forward positions along the side of the body portion 300. Within the track is a spring 331 which fits between an inner surface of the opening 329 and the handle 330 to bias the shuttle body in the remote position.

FIG. 11 is a perspective view of the opposite side of the shuttle body 310 from that shown in FIG. 10. The lower portion 318 of the shuttle body 310 comprises a plurality of spaced apart block portions 338, 340, 342, 344 and 346 which are attached to the planar portion 324. In the preferred embodiment, each of the block portions 338–346 have a planar surface 348 which all lie in a single plane. Three of the block portions 338; 342; 346 are equipped with T-shaped runners 350; 352; and 354, respectively. These are disposed to fit within spaced apart grooves located within a side of the body portion 300. One such groove 356 is illustrated in FIG. 10. Also illustrated in FIG. 11 is spring guide 362 for properly aligning spring 331.

The blocks 338–346 are separated by slots which surround the blades 304–309 during movement of the shuttle body 310 up and down along the side of body portion 300.

FIG. 12 shows the toy completely assembled with channel portion 302 and shuttle body 310 connected to body portion 300. A portion of planar portion 324 is cut away to expose the relationship of the block portions 338–346. to the blades 304–309.

Figure 13:
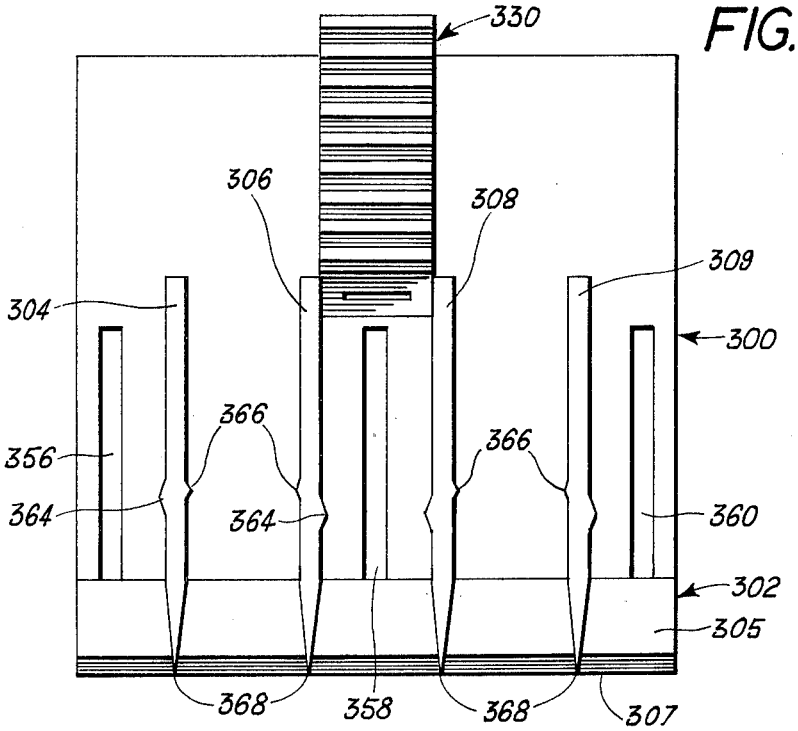
FIG. 13 is an elevational view of a second portion of the toy of FIG. 10.

FIG. 13 shows a frontal view of the body portion 300 equipped with the handle 330; blades 304–309, seen from a longitudinal end view; and channel portion 302. Also shown in FIG. 13 are the position of the grooves 356–360 with respect to the blades. Each of the blades contains a plurality of cams, the cams on each blade being divided into two different types: major cams 364 and minor cams 366. In the preferred embodiment, there are two major cams on one side of each of the blades and two minor cams on the opposite side. The two major cams are in alignment as are the minor cams as seen perspectively in FIGS. 10 and 12. Each of the blades of FIG. 13 are seen to be tapered to a cutting edge 368. In the preferred embodiment castle-making toy, the cutting edges 368 of the blades are in a single plane with the cutting edge 307 of the wall portions of the channel portion 302.

Figure 14:
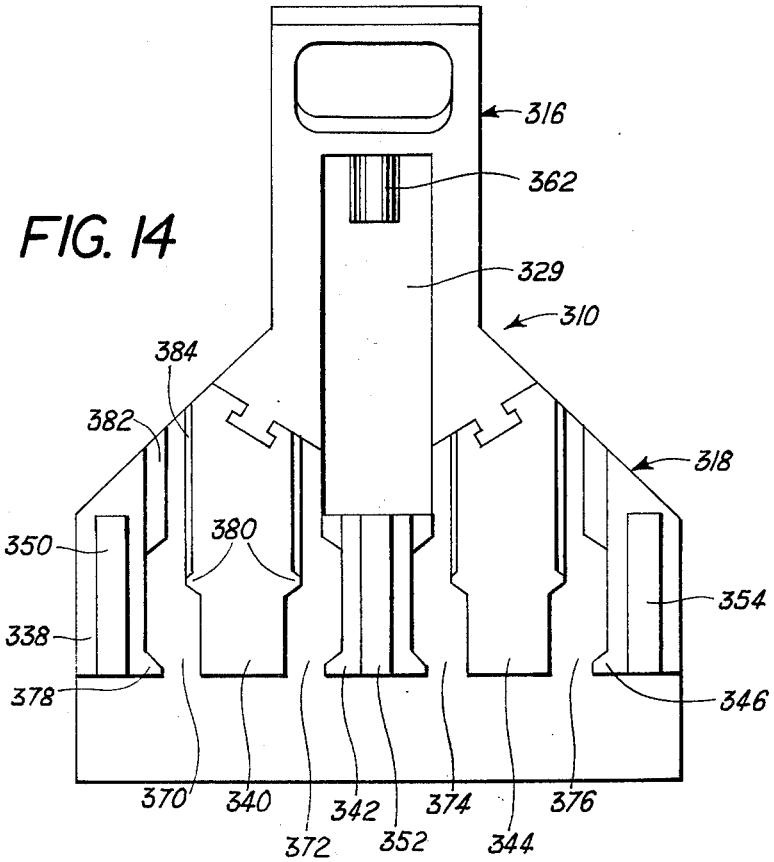
FIG. 14 is an elevational view of a first portion of the toy illustrated in FIG. 11.

FIG. 14 shows an elevational view of the shuttle 310. The runners 350–354 which are matable with the grooves 356–360 are clearly shown as are the block portions 338–346. The block portions are separated by slots 370–376. These slots being disposed to surround the blades as the shuttle body 310 is moved between the remote and forward positions along the side of the body portion 300. That is, as the runners 350–354 move up and down within the grooves 356–360, the slots 370–376 move along the blades 304–309. However, the slots are equipped with slot major cams 378 and slot minor cams 380.

The blade and slot cams are provided as an oscillating means for moving the blades 304–309 back and forth along the body portion 300. More specifically as described earlier, the blades are attached along an upper portion of a longitudinal edge of each blade to the body portion. This leaves the rest of the blade free to move back and forth. The blades are flexible so that they will not snap. The tapered end portions of the blades adjacent the channel portion 302 of the toy move back and forth along wall portion 305 in response to the interaction of the blade and slot cams.

Figure 15:
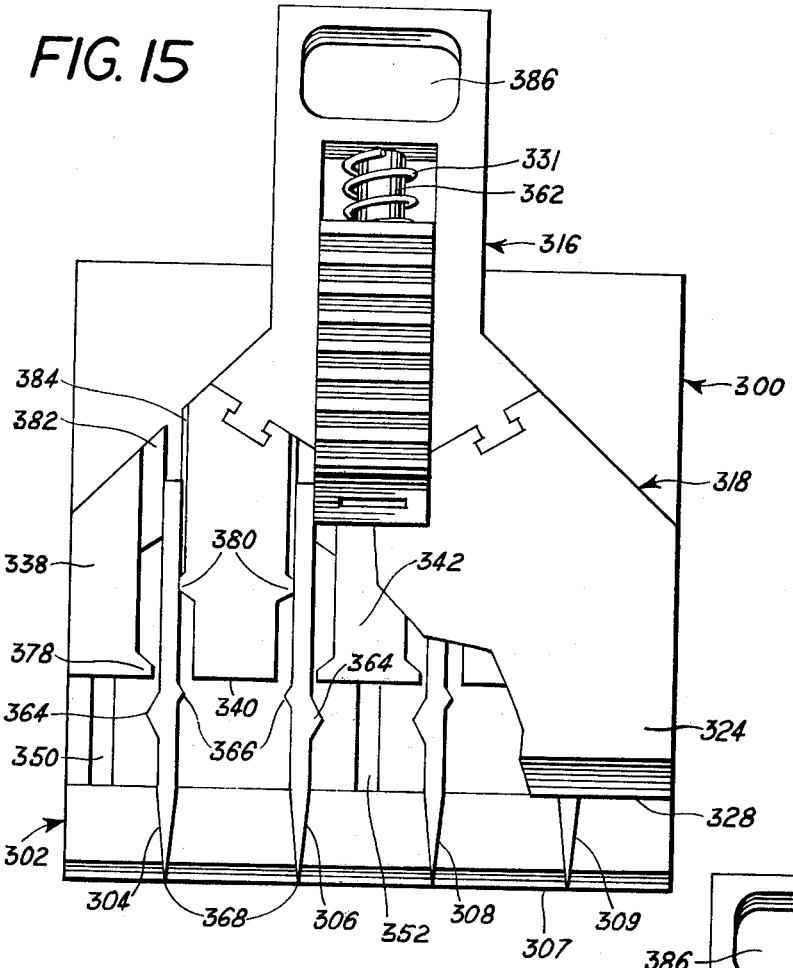
FIG. 15 is an elevational view of the assembled toy of FIG. 12 with a first portion in a remote position having a portion broken away to expose the interior of the toy.
Figure 16:
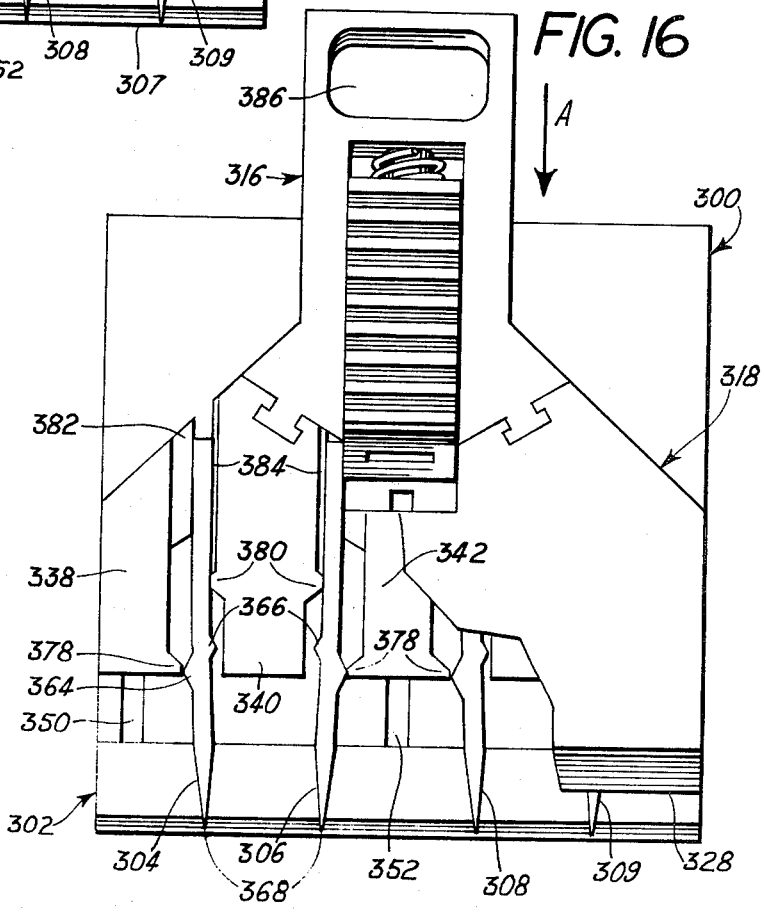
FIG. 16 is an elevational view of the assembled toy of FIG. 12 showing a first portion in a position intermediate the remote and forward positions with a portion broken away to expose the interior of the toy.

FIGS. 15–17 are elevational views of the toy with the shuttle body 310 and channel portion 302 attached to the main body 300 with a portion of planar portion 324 cut away. Each of the figures show a different relative position between the shuttle body 310 and body portion 300.

In FIG. 15, the shuttle is in the remote position, biased there by a biasing means such as spring 331. The slots between the block portions are not in surrounding relationship with the lower part of the blades as yet.

In FIG. 16, the shuttle body 310 has moved to a position intermediate the remote position of FIG. 15 and the forward position of FIG. 17. Here as the shuttle is pushed lower by gripping the upper portion 316 in opening 386 and pushing in the direction of arrow A, the slot major cams 378 contact the blade major cams 364 to move the blades to one side. See for example blade 304 moved to the right; blade 306 to the left, etc.

As the shuttle body 310 is moved even lower to a forward position which is that shown in FIG. 17, the blade minor cams 366 contact the slot minor cams 380 to move the blades to one side opposite from the position obtained by the blades when the major cams are in contact. Now, blade 304 has been moved to the left and blade 306 to the right and so on.

When the toy is first inserted into the sand, the channel portion 302 fills with sand until it presses against the roof of the channel and can be inserted no farther. At the same time, the blades 304–309 cut through the sand or material. In the preferred embodiment, the cutting edges 307 of the channel portion 302 and the cutting edges 368 of the blades are in a single plane. When movement of the main body and channel portion stops, the user takes hold of the upper portion 316 at the opening 386 and presses down in the direction of the arrow A against the action of the spring 331. The stright edge 328 on the planar portion 324 moves down and slices through the sand or material forming a slot which is spaced apart and parallel to the axis of the channel, the slot being spaced apart from the nearest channel wall portion by a distance at least as great as the width of the blades. The sand on the side of the slot remote from the body portion is later removed to leave the parapet wall behind adjacent to the channel.

As the toy is withdrawn from the mound of sand, the compressed spring acts to move the shuttle body 310 back to the remote position whereupon the action of the cams is repeated.

In order to smoothly remove the portion of sand on the side of the longitudinal slot remote from the channel and formed by the straight edge 328, a hoe designated generally 390 is provided with the toy. See FIGS. 18–20. The hoe comprises a hoe blade designated generally 392 and a hoe handle portion designated generally 394. The preferred embodiment hoe has a blade 392 which is transverse to the hoe handle 394. The hoe blade 392 comprises a planer portion 396 and tapered end portion 398 connected thereto, the tapered end portion having a cutting edge 400. The hoe 390 can be inserted into the main body portion 300 of the toy in the manner shown in FIG. 21 where the dotted line shows the hoe handle portion 394 and the blade portion 392. As can be seen from FIGS. 21 and 22, the blade portion 392 of the hoe 390 fits within an opening in a side 402 of the body portion 300 of the toy, while a portion of the hoe handle 394 transverse to the blade fits within the body portion 300 and extends into the handle 330 of the toy. FIG. 22 is a view of the body portion 300 of the toy showing the hoe portion in place within the toy with hoe planar surface 396 clearly visible.

FIG. 21 also shows a depression 399 which is configured to receive one end of spring 331.

The hoe itself can be separated into two parts comprising: the hoe blade and a first portion of the hoe handle; and a second portion of the hoe handle designated generally 404 in FIG. 23 which separates from the first portion and acts as a window and doorway maker for making windows and doorways in the damp sand. A first end 406 of the window and doorway maker 404 inserts into a hollow portion in the first portion of the hoe handle. Extending from this end 406 is a plurality of spaced apart tabs 408. By inserting these two tabs into the wall of sand, openings are created which appear as windows in the castle wall. The second portion designated generally 410 is grasped as a handle when used in this manner.

The second end 412 of the doorway and window maker 404 remote from the first end 406 having the tabs has a cavity 414 therein that can be seen most clearly by looking at an end view of the window and doorway maker in FIG. 24. This cavity 414 has an arch 416 and when this end of the window and doorway maker is pushed into the mound of sand, the sand fills up the cavity 414 until it meets resistance. When the tool is withdrawn, the sand is withdrawn with the tool leaving an opening or channelway. When finished, this tool is inserted back into the remaining portion of the hoe handle, and when the need for the hoe tool itself is finished, it is inserted back into the castle-making toy.

In order to access the hoe from its position within the castle-making toy, an opening is present in the bottom of the handle 330 of the toy. This is labelled 336 in FIG. 10 and, by placing a finger in this opening and pressing against a portion of the hoe, it can be removed from the tool.

Figure 25:
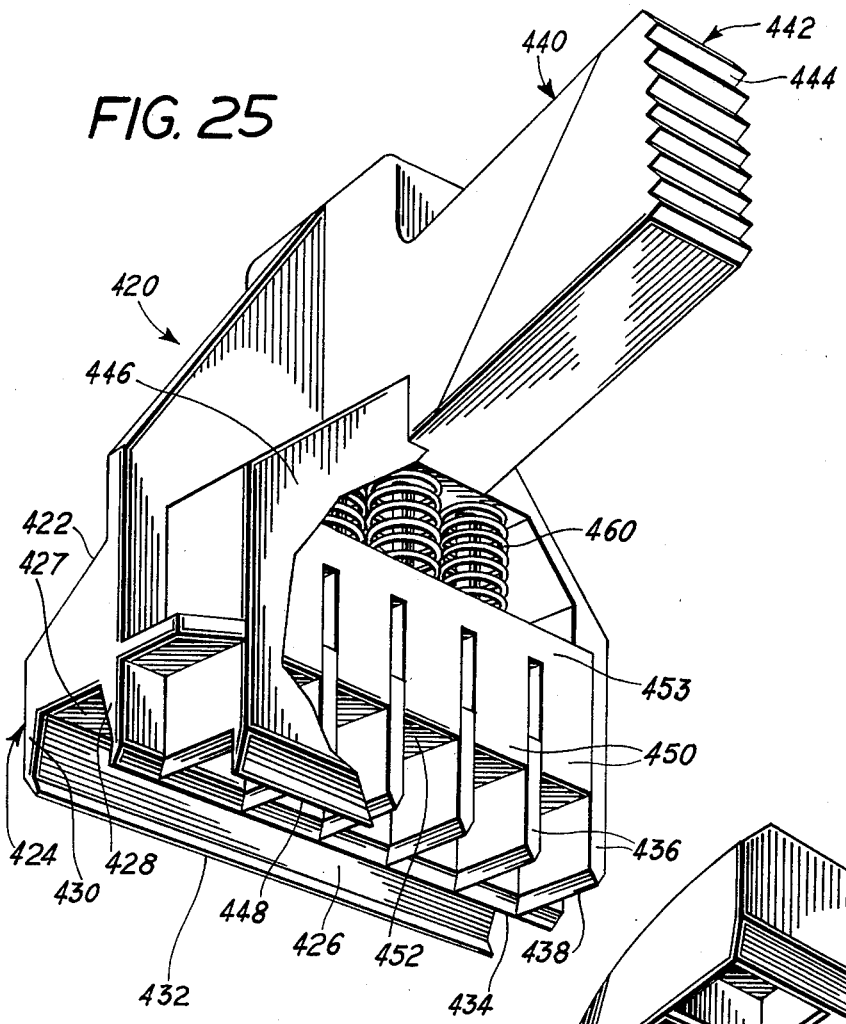
FIG. 25 is a perspective view of an alternate embodiment of the toy of FIG. 12.

Another embodiment of the castle-making toy is shown in FIG. 25 designated generally 420. It is comprised of a body portion 422 and a banquette means for making channels in said sand comprised of a channel maker designated generally 424. The channel maker has a channel region 426 which is formed by an underside of the body portion 422 labelled 427 and wall portions 428 and 430 which extend from the body portion 422. As discussed before, the wall portions have tapered tip portions 432 and 434. The toy 420 also comprises blades 436 which are attached to the body portion 422 along a longtiduinal edge. Unlike previous embodiments wherein portions of the blade were free to move from side to side, these blades are not. The blades have a tapered cutting edge 438.

For easy operation of the toy, a handle designated generally 440 is attached to the body portion 422. One end of the handle designated generally 442 remote from the body 422 has a plurality of spaced apart grooves 444. When these grooves are placed into the damp sand or other granular material, they leave a step-like impression in the sand.

A portion of one face 446 of the castle-making toy is shown broken away. This face 446 has a straight cutting edge 448 attached thereto at the end. This straight cutting edge 448 cuts into the sand at a spaced apart distance from the channel maker 424 to thereby form the width of the parapets. This distance is at least equal to the width of the blades 436.

Between the blades 436 there are a plurality of block portions 450. The block portions 450 each have a planar surface 452 which planar surfaces 452 are in the same plane and which plane is spaced apart from the plane of the cutting edges of the channel maker 424. The block portions are movable from a forward position to a remote position and back again. The block portions are biased into the forward position by a series of springs 460 located between a portion of the toy adjacent to the handle 440 and the top surface of a portion 453 of the toy connecting the block portions 450. As the sand presses against the flat surfaces 452 as the toy is pressed into the sand, the block portions 450 and connecting portions 453 move to allow sand to fill the space between the blades as well as the region 426. As the toy is removed from the damp sand, the springs 460 exert a force on the block portions 450 to push them to the forward position and to keep the sand from adhering within the toy adjacent to the blade sidewalls. This is necessary in order to form slots in damp sand adjacent to the channel formed by the channel portion 424 without having portions of the sand adhering to the blade side surfaces. This leaves behind the merlons necessary to complete the battlement.

Figure 26:
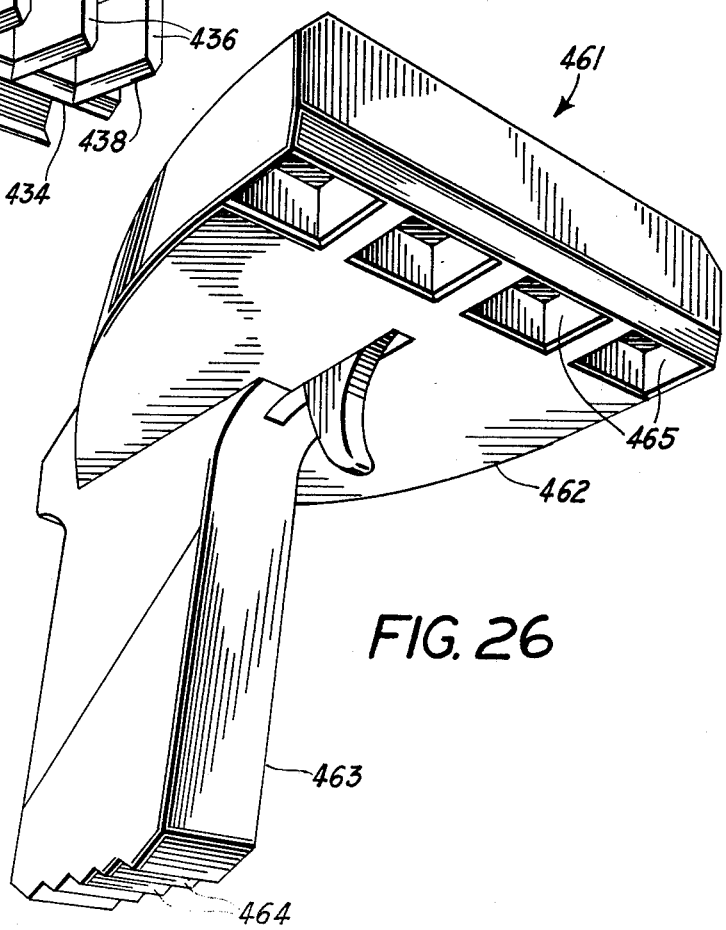
FIG. 26 is a perspective view of a preferred embodiment of applicant's parapet making toy.

FIG. 26 presents a perspective view of a merlon maker designated generally 461. Merlons are the portions of the parapet separated by the slots which lie adjacent to the banquette. The merlon maker 461 comprises a body portion 462 and a handle portion 463. One end of the handle portion 463 has a plurality of spaced apart step-like grooves 464 which, when pressed into damp sand or other granular material, forms an impression that looks like a set of stairs. The body portion 462 has contained therein a plurality of channels 465. In the perferred embodiment, these channels are evenly spaced apart and parallel.

Figure 27:
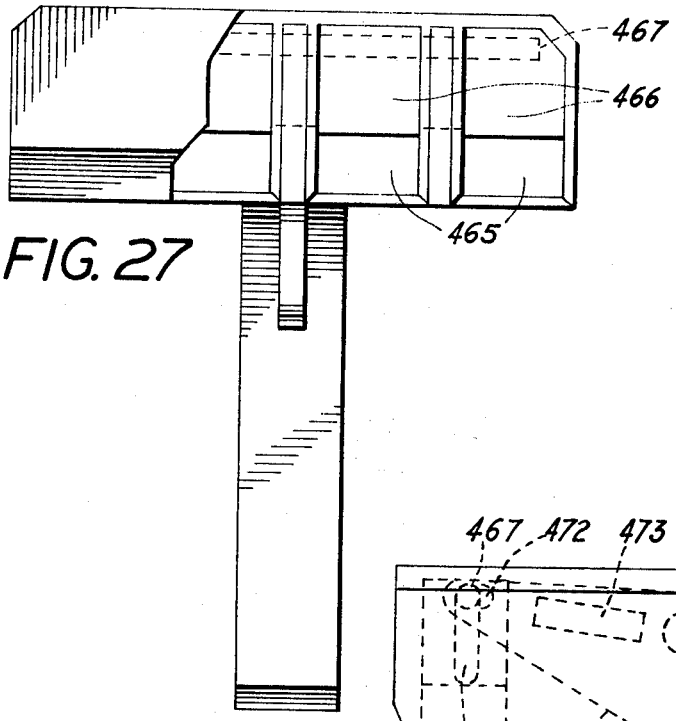
FIG. 27 is a front elevational view of the toy of FIG. 26 with a portion of the body broken away.
Figure 28:
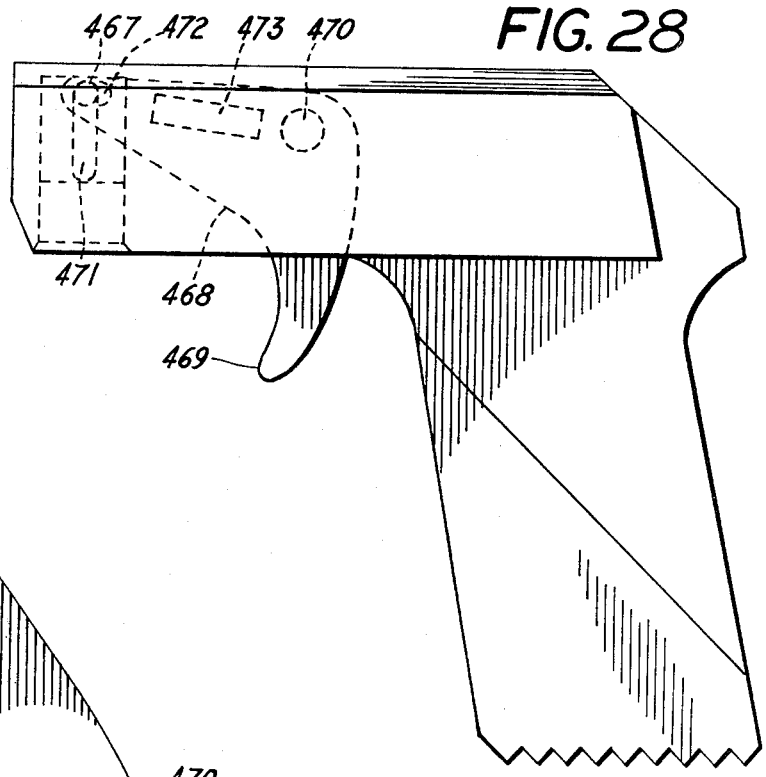
FIG. 28 is a side elevational view of the toy of FIG. 26.
Figure 29:
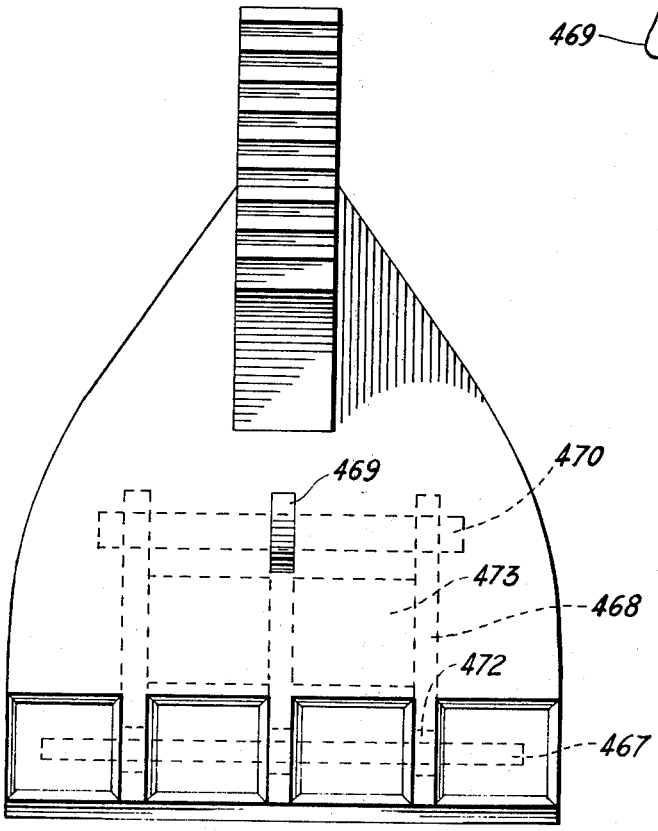
FIG. 29 is a bottom planar view of the toy of FIG. 26.

FIG. 27 is a front view of the merlon maker with the housing of the cavity portion partially broken away to expose a plurality of blocks 466 which move within the channels 465. Each of the blocks 466 has a transverse hole through it and a connecting rod 467 (shown in phantom lines in FIGS. 27–29) is positioned within these transverse holes. Thus, the blocks are linked together by the rod for purposes of movement within the channels 465. In order to effectuate this movement, a bell-crank mechanism is provided, comprising a lever arm portion 468 and a trigger portion 469 mounted for pivotal movement about a pivot pin 470. As the trigger 469 is moved counterclockwise about the pivot pin 470 when viewed as in FIG. 28, the end of the lever 468 is likewise moved counterclockwise. The end has a slot 472 as illustrated in FIG. 28 which accommodates the connecting rod 467. This allows the connecting rod to traverse vertically within the slot 471 in the body of the merlon maker housing. Thus the blocks 466 can be moved downwardly within the channels 465. The tool is used in the following fashion: it is raked through the sand and the sand fills the cavity portions 465 and is compressed therein. In order to push out the sand which is now in block form, the trigger is squeezed and the blocks push the sand out as sand blocks. These emerge assembled in a series of merlons which look like a parapet with a series of slots. They are preferably deposited along a flat shelf or step in the side of a mound of sand which simulates a castle banquette. FIG. 29 shows that, in the preferred embodiment, there are a plurality of lever portions 468 which run between the connecting rod 467 and the pivot rod 470, all of which are pivoted by squeezing a single trigger 469. The trigger and these additional lever portions may be connected by a reinforcing "R" 473 shown in phantom lines in FIGS. 28 and 29.

Figure 30:
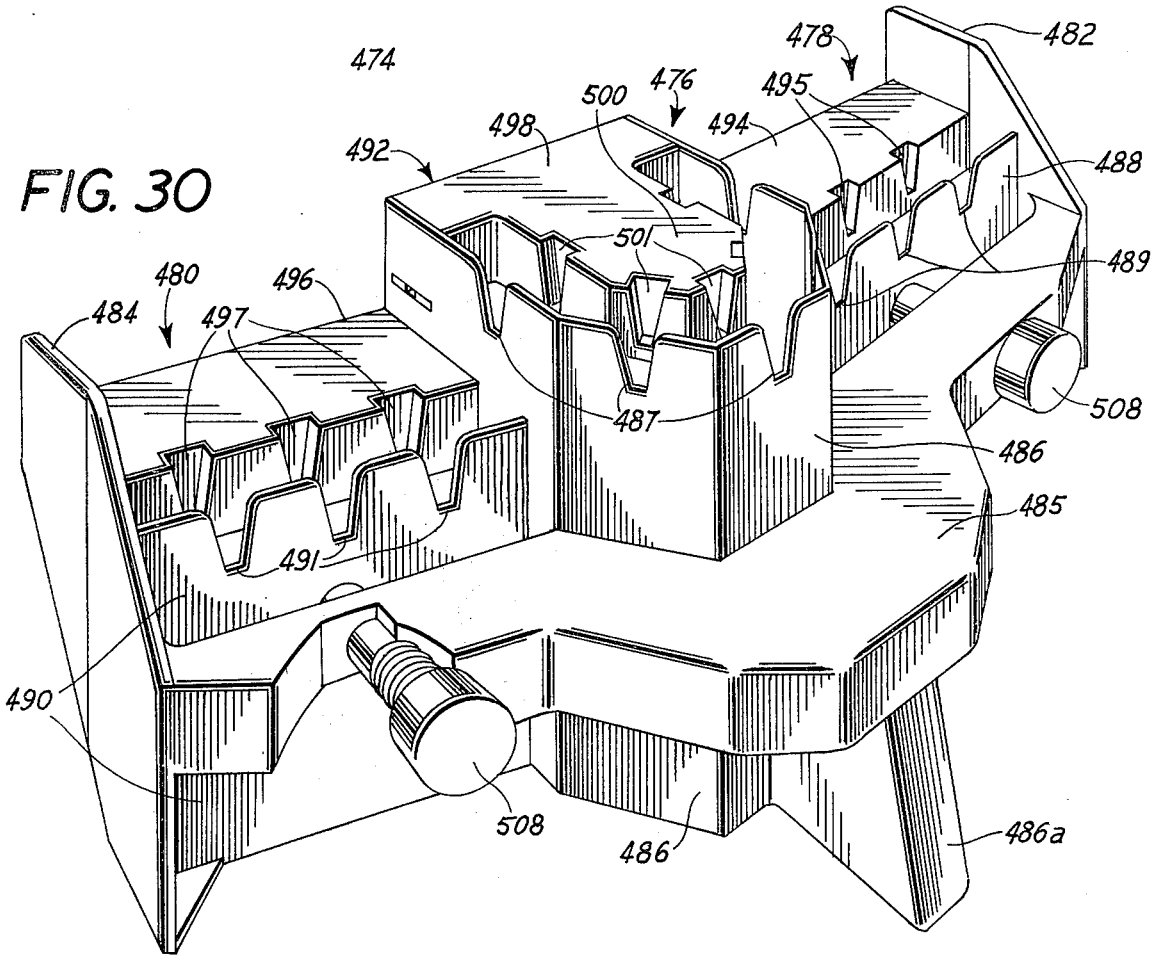
FIG. 30 is a perspective view of a preferred embodiment of applicant's castle making mold.

In FIG. 30, a mold designated generally 474 for making a tower and side banquette for a castle to be made in damp sand or other granular material is illustrated. The mold 476 comprises a tower means designated generally 475 for forming the walls, banquette and parapets of a tower, and side battlement means designated generally 478 and 480 for forming side banquettes and parapets adjacent to the tower. End walls 482 and 484 are attached to the side battlement means 478 and 480 at the ends remote from the tower means 476.

The tower means 476 is comprised of a tower wall portion 486 and a tower banquette insert designated generally 492 having a first portion 498 which engages the tower wall of a second portion 500 which is spaced apart from the tower wall 486. The side battlement means 478 and 480 comprise side banquette wall portions 488 and 490, respectively, and side banquette inserts 494 and 496, respectively, which are spaced apart from their respective side banquette wall portions 488 and 490.

The side banquette inserts 494 and 496 engage the tower wall portion 486 at one end and engage the end walls 482 and 484, respectively, at their opposite ends. The side banquette wall portions 488 and 490 are similarly situated between the tower wall portion 486 and end walls 482 and 484, respectively, but they are spaced apart from the side banquette inserts along their lengths or sides.

In order to manipulate the mold for use in the sand, a handle portion 485 is provided which is attached to the end walls 482 and 484 and a portion of the tower wall 486.

In order to use the mold for the center tower and side banquette maker of FIG. 30, which shows a frontal perspective view of the mold, damp sand or other capillarily held insoluble granular material is placed or pressed into the mold from behind. The sand will then be compressed against the wall portions 488, 486 and 490, which are the side walls and center tower wall. The sand is then placed into the space between the side banquette inserts 494 and 496 and the side banquette walls 488 and 490 from above. The damp sand placed in this region will come in contact with the damp sand pressed against the walls 488 and 490 from behind forming a continuous sand "casting". Similarly, damp sand or other material is deposited in the space between the center tower insert portion 500 and the center tower wall 486 from above to come in contact with the sand below. The side banquette inserts 494 and 496 and the center tower insert 492 will prevent sand from filling the regions taken up by the inserts. The excess sand lying on the top surfaces of the inserts 492, 494, and 496 is then removed. The tower wall portions 486 are flexible and can be squeezed to part the sand from adhesion to the sides of the walls themselves. In the preferred embodiment the tower wall portions have a vertically, downwardly extending foot **486*a* which serves as a brace to prevent the mold from tipping towards the user as he packs it with sand. The insert 492 is removable and can be removed before the mold is withdrawn from the sand. After the insert 492** has been removed, the mold is withdrawn vertically from the sand leaving the casting behind, the casting having a center tower banquette and two side banquettes on opposite sides of the center tower banquette.

Figure 31:
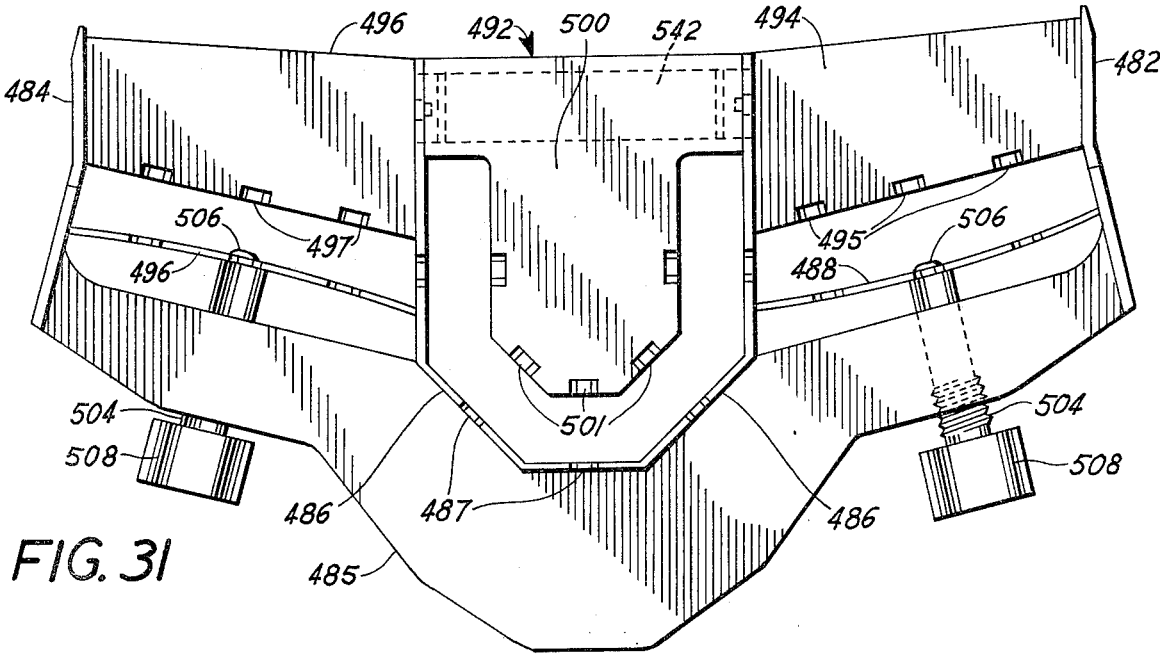
FIG. 31 is a top planar view of the mold of FIG. 30.

In order that sand or other material does not adhere to the side walls 488 and 490, they are made flexible and a means for flexing the side wall is provided with the mold. In FIG. 31, a pair of threaded shafts or bolts 504 are connected at one end 506 to the side banquette walls 488 and 490. The other end of each threaded shaft or bolt 504 is connected to a head 508 which is adapted to be turned manually. Each threaded bolt and head is supported by a threaded hole in the handle 485, the threaded hole disposed to be matably engaged by the threaded shaft 504. As the head 508 is turned counterclockwise, for example, the threaded shaft is withdrawn from the threaded hole pulling on the wall 488 and withdrawing it from contact with the sand which is in place between the wall 488 and the side banquette insert 494. On the other side, the head 508 in contact with wall 496 has been turned clockwise and the shaft has been screwed further into the handle so as to flex wall 496 in a different direction from the wall 488. This helps to compact the sand and then when the wall is flexed in the other direction as, for example, by turning the head and threaded shaft counterclockwise as illustrated on the right hand side with wall 488, the sand is easily parted from adhesion to the side banquette wall portions 488 and 490. The shaft and threading within the handle is shown dotted in FIG. 31 while that portion of the handle is shown broken away in FIG. 30 exposing the partially threaded shaft.

The center tower banquette insert 492 is equipped with a series of spaced-apart grooves 501 around the second portion 500. Slots 487 are presented in the center tower wall 486 and there is one slot 487 aligned with each groove 501. The grooves and slots are wider at one end and taper gradually to the narrower end. Each of the side banquette inserts 494 and 496 are similarly equipped with a plurality of spaced-apart grooves 495 and 497, respectively, and the side banquette walls 488 and 490 equipped with a plurality of slots 489 and 491, respectively, which are aligned with the grooves 495 and 497. These grooves and slots provide guides for a crenelle rake for making crenelles in the parapet wall portions of the center and side battlements.

Figure 32:
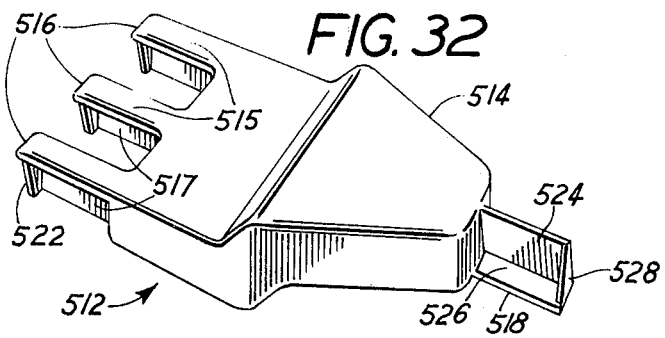
FIG. 32 is a perspective view of the preferred embodiment of applicant's crenelle rake.
Figure 33:
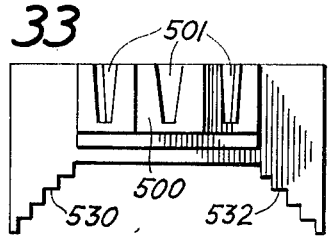
FIG. 33 is a front elevational view of a portion of the mold of FIG. 30 as shown in the upper portion of the exploded perspective view of FIG. 35*a;*

FIG. 32 illustrates a crenelle rake which is equipped with a body portion 514. Extending from a first end are a plurality of extensions 516, while extending from a second end opposite from the first end is a similar extension 518. These extensions act as rakes and are positioned in alignment with the grooves and slots in the banquettes and walls, respectively.

Each of the extensions 516 comprises a plurality of thin planar portions. Two of the portions 515 and 517 on each extension form the length of the extension with the two portions being transverse to one another. The third portion is a planar end portion 522 which has the shape of the grooves and slots and is transverse to portions 515 and 517. The planar end portions 522 are positioned within the grooves 495 or 497 with the planar portions 517 in slots 489 or 491. As the rake is pulled from the groove through the slots, the end planar portions 522 pull the sand from the location between the banquette insert and banquette wall out through the slot in the banquette wall there it can be disposed of. The sidewall portions, as in the preferred embodiment, have three parallel grooves and slot combinations and therefore the crenelle rake of FIG. 32 shows one end with three parallel and spaced apart extensions.

Since the tower wall may be comprised of several sides, each side having only one slot as in the preferred embodiment shown in FIG. 30, the crenelle rake must have a single extension such as 518 at one end configured similar to the extensions at the opposite end so that single extension can create a crenelle through the single slot in each sidewall of the tower portion. Extension 518 has longitudinal planar portions 524 and 526 and end planar portion 528.

Figure 34:
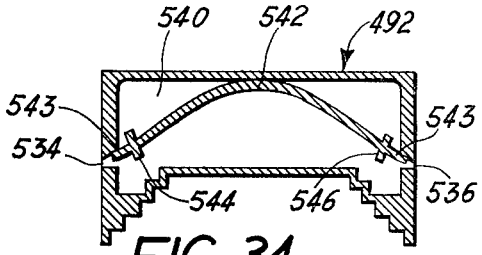
FIG. 34 is an inverted cross-sectional view of the portion shown in FIG. 33 taken along the lines and arrows 34—34 in FIG. 35.
Figure 35A:
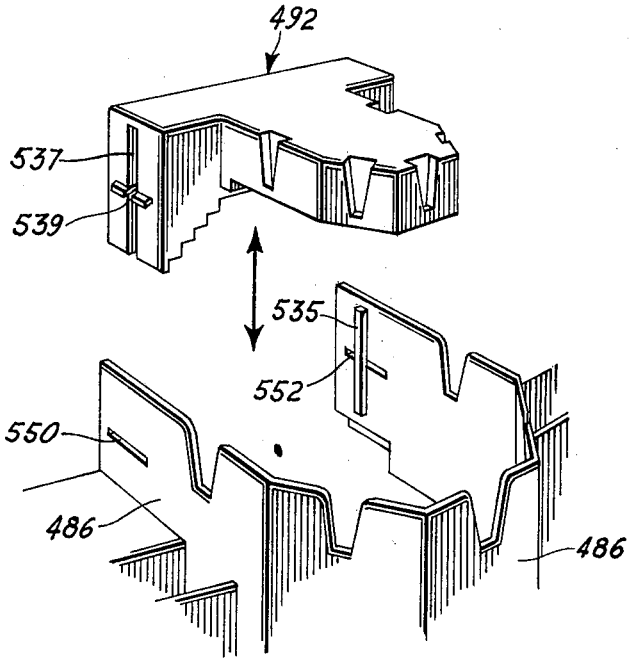
FIG. 35*a* is a perspective view of the portion of the mold of FIG. 33 shown exploded away from a portion of the castle making mold.
Figure 35:
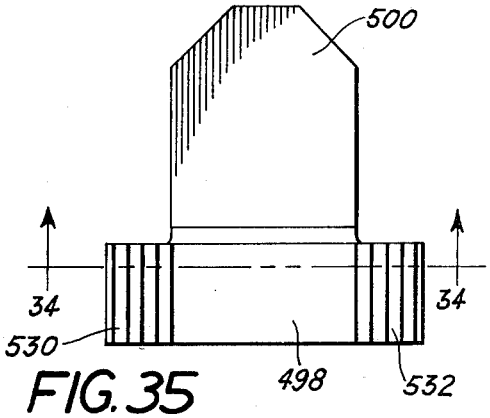
FIG. 35 is a bottom planar view of the portion in FIG. 33.

The tower banquette insert is shown in more detail in FIGS. 33 through 35*a*. FIG. 35 is a bottom view of the insert showing the spaced-apart portion 500 and the portion engaging the sidewalls 498. The portion 498 is generally rectangular in shape with each end of the rectangular portion engaging opposite side walls of the tower. The end portions of portion 498 have step-like grooves 530 on one side and 532 on the other. The step-like grooves 530 and 532 can also be seen in FIG. 33 along with the spaced apart grooves 501 in portion 500.

FIG. 34 is a rear cross-section of the insert showing locking means for holding the tower banquette insert 492 in position in the tower means. The ends of the portion 498 have slots 534 and 536 contained therein. These slots communicate between a hollow interior 540 and the atmosphere outside the center tower insert. Within the hollow interior 540, there is located a bowed strip 542 whose ends 543 are disposed to slip through the slots 534 and 536. To insure that the bar will not be straightened enough to slide through the slots, small bar sections 544 and 546 are located near the ends 543 of the sliding bar 542 and transverse to the bar and the slots 534 and 536. Hence, as the bowed strip 542 is straightened out so that the end portions 543 of the bar slip through the slots 534 and 536, the bar sections 546 and 544 prevent the bowed rod from being removed from inside the insert.

FIG. 35*a* shows more clearly how the tower insert 492 engages the tower walls 486. Slots 550 and 552 in tower walls 486 are clearly visible, and the tower walls 486 are equipped with guide rods 535 attached thereto on the inside surface and which run across the slots 550 and 552. Only one such rod is visible in FIG. 35*a* but both slots 550 and 552 are so crossed.

The tower insert 492 is shown with guide grooves 537 in FIG. 35*a* which are adapted to mate with guide rods 535. In the preferred embodiment, the grooves 537 and rods 535 are vertically oriented so that as insert 492 is inserted among the tower walls 486, it will be guided downward or upward along the grooves and rods.

The bowed strip is shown in the loaded position in FIG. 34. The strip in this position behaves as a spring and the ends 543 thereof exert a force outward tending to straighten out the strip. When the insert is placed among the tower walls, the ends 543 of the strip 542 are already in position in slots 534 and 536 but are kept from extending beyond the walls of the insert by the inside surface of the tower walls. However, when the insert is properly oriented among the tower walls along guide rods 535 and the slots 550 and 552 are aligned with the slots 534 and 536 respectively, the ends 543 of bowed strip 542 will penetrate the slots 550 and 552. In order to enter the slots 550 and 552 with rods 535 thereacross, the ends of strip 542 have slots 539 therein which are adapted to embrace rods 535. Once this takes place, the tower insert becomes locked in position. The rear view of the mold in FIG. 36 illustrates the position of the strip ends within the insert and tower wall slot.

Figure 36:
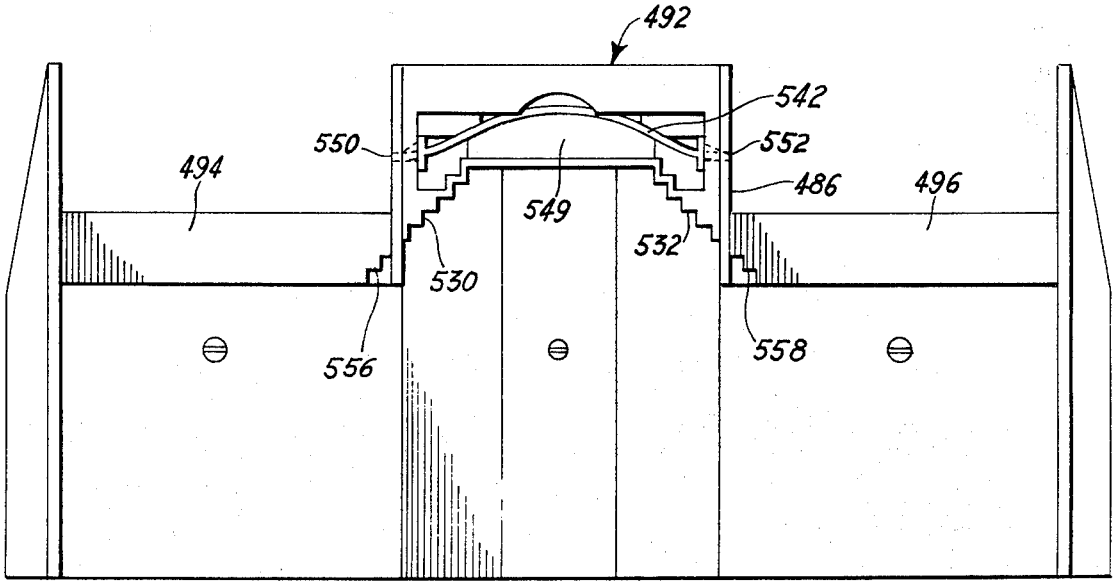
FIG. 36 is a rear elevational view of the mold of FIG. 30.

FIG. 36 illustrates an opening 549 in the back of the insert which allows access to the bowed strip 542 so that it can be pushed upward to remove the ends from the slots 550 and 552 in the sides of the tower walls 486. This then unlocks the insert and allows it to be removed from the remainder of the mold for easy removal of the mold from the sand.

The step-like groove portions 530 and 532 on the rectangular portions 498 of the insert will act to leave a step-like depression in the sand which is forced into the back of the mold. The side banquette inserts 494 and 496 have step-like grooves 556 and 558 respectively in one corner which align with the step-like grooves of the center tower banquette insert. Sand is pressed into the back to engage the back side of the sidewalls 490, 488, and the center tower walls 486. The absence of sand where the banquette inserts 494 and 496 occur will leave a depression in the casting which acts as the banquette region. This occurs similarly where the center tower banquette 492 is positioned. The step-like grooves lead from the side banquettes to the center tower banquette. It will be appreciated that just like the circular embodiment of FIG. 5, the tower means of FIG. 30 could be equipped with a circular tower wall portion 486 instead of a multi-sided wall portion in the shape of a polygon as in FIG. 30.

Referring now to FIG. 37, an alternate embodiment of a mold for making miniature toy castle battlements in a capillarily bound insoluble material such as damp sand is illustrated. The mold comprises a body portion designated generally 599 having a plurality of sides. The body has a planar banquette surface designated generally 600 which forms a channel in the sand or material when pressed therein. This surface comprises side banquette surfaces 602 and 604 and tower banquette surface 606. The tower banquette surface has a multi-sided perimeter with sides 608 in the shape of a portion of a polygon. Alternatively, the shape of the perimeter of the tower banquette surface 606 could be circular.

The mold also comprises a plurality of spaced-apart block portions 610 mounted or connected to a side of the body portion 599, each of the block portions 610 having a planar parapet surface 612 which, in the preferred embodiment, are all in a single plane parallel and spaced apart from banquette surface 600. These surfaces 612 smooth out the surface ajdacent to the channel formed by the banquette surface and in an elevated plane thereto to form a parapet wall.

A second sliding member or movable crenelle maker designated generally 614 is adapted to slide within the body portion 599 along runners at either side such as the runner 601, FIG. 37, which slide in grooves (not shown) in divided portion 599. Extending from the body portion 615 of the crenelle maker 614 are a plurality of spaced apart blade extensions 616 which are adapted to slide between the slots created by the spaced apart blocks 610. The blades 616 have tapered ends 618 which slice through the damp sand or other material to provide slots therein. The crenelle maker 614 is equipped with a handle portion 619. FIG. 38 shows the sliding member in the forward position wherein the blades have extended all the way through the slots and the cutting edges of the blades are in a plane parallel with the banquette surface 600. Hence, this mold will provide banquettes and merlons, the merlons being formed by the flat surfaces 612 on the blocks 610 and the crenelles formed by the blades 616. In the preferred embodiment, the mold of FIGS. 37 and 38 is used where miniature castle battlements are desired, that is, battlements considerably smaller than the battlements made by previously described embodiments. For example, the width of the banquettes formed by the surface 600 might be $\frac{3}{8}$ of an inch or smaller.

The mold with the crenelle maker 614 in the forward position as in FIG. 38 is pressed into the sand. Then the crenelle maker 614 is slid away from the sand along runners 601 to a remote position shown in FIG. 37. Finally the mold is withdrawn.

FIGS. 39–41 illustrate a village maker for forming a toy village in a capillarily held insoluble granular material such as damp sand, the village maker comprising a retaining box designated generally 702 in FIG. 40 and a plurality of village blocks designated generally 704 in FIG. 39. The retaining box 702 is, in the preferred embodiment, square in cross-section with rectangular walls having an open top. On opposite walls 706 and 708, holding bars 710 are fixed thereto. FIG. 40 does not show the holding bar affixed to side 708, but one is fixed thereto and in a plane with holding bar 710 and parallel thereto.

Opposite sides 712 and 714 each have a plurality of openings 716 through which holding bars 718 of FIG. 41 pass. In the preferred embodiment, there are a pair of openings 716 in each side 712 and 714 which openings are all in the same plane which is parallel and spaced apart from the plane of the open side of the box 702. Each opening in a side is aligned with an opening in the opposite side, and all holding bars lie in the same plane.

In the preferred embodiment, there are nine village blocks 720 through 728 which fit within the retaining box 702, but a retaining box could be made in the shapes and sizes to accommodate a different number of blocks. For example, a retaining box could receive blocks hexagonal in cross-section. Generally, each of the village blocks is of a different length and square in cross-section. The blocks in FIG. 39 each comprise a pedestal portion 730 which is set off from the rest of the block by a groove 732 which surrounds the perimeter of each block. As the blocks are arrayed in the retaining box, a holding bar is slipped through an opening 716 in a wall of the box and along the aligned grooves of the arrayed blocks assembled in the retaining box. When all nine blocks are thus arrayed with the holding bars in place through the openings on each side of the box, the blocks become retained within the box. Thus, the openings 716, grooves 732, holding bars 710 and 718 act as an aligning and retaining means for holding the village blocks 704 in the retaining box 702.

Several of the village blocks 704 comprise a different shape and textured end portion. For example, village block 720 has an end portion with a planar smooth surface 734 which is perpendicular to the axis of the block; the end portion of block 721 comprises a plurality of planar surfaces 736 and 738 which are parallel and spaced apart from one another and perpendicular to the axis of the block; the end portion of block 722 has a plurality of spaced apart grooves lying in a single plane 740 which is transverse to the axis of the block; block 723 has an end portion with a planar surface 742 perpendicular to the axis of the block, and a portion 744 having a plurality of spaced apart grooves lying in a single plane and transverse to the axis of the block; block 725 has an end portion comprising a plurality of triangular sections 746, each triangular section having a plurality of spaced apart grooves lying in a single plane, each plane transverse to the axis of the block and sharing a common triangular side with an adjacent triangular section; the end portion of block 726 is V-shaped having a plurality of spaced apart grooves lying in each plane 748 which forms the V-shape. In the illustration of FIG. 39, blocks 724 and 728 are similar to block 722; block 727 is similar to block 726.

Hence, the different lengths and the different shapes and textures of the end portions provide a multi-textured and shaped impression in the damp sand giving the appearance of roofs of buildings, etc., in a village when the retaining box with blocks retained therein is pressed into a mount of sand. The walls of the village buildings are flat planar surfaces substantially perpendicular to the rooftop impressions. The appearance of the village can be varied easily by rearranging the blocks within the retaining box or using different shapes and textures from that described above. For example, a Moorish village will have a different appearance than a feudal European farming village.

FIG. 42 shows nine village blocks designated generally 704′ assembled within the retaining box designated generally 702. They are held in place with the retaining bars 718 as shown. A portion of a retaining box wall has been broken away to show the pedestal portion of the blocks 704′ in FIG. 42. These blocks can be varied in length to give an added dimension to the flexibility of the appearance of the village formed thereby.

FIG. 43 shows one of the blocks designated generally 724′ having a length adjusting means for varying the length of the block 724′. The block 724′ comprises a pedestal portion designated generally 752 which comprises a pedestal portion 754 and a threaded shaft 756. The threaded shaft 756 which is in contact with the pedestal 754 is not threaded along its entire length but has an intermediate portion 758 adjacent portion 754. The threaded shaft is disposed to matably engage a threaded portion in the upper portion 760 of the block 724'. By turning the pedestal portion and screwing the upper portion 760 along the threads, the height of the block 724' can be varied. See, for example, FIG. 44.

It will be understood that various changes in the details, materials and arrangement of parts which have been herein described and illustrated in order to explain the nature of this invention may be made by those skilled in the art within the principle and scope of the invention as expressed in the following claims.

It will further be understood that the "Abstract of the Disclosure" set forth above is intended to provide a non-legal technical statement of the contents of the disclosure in compliance with the Rules of Practice of the U.S. Patent and Trademark Office, and is not intended to limit the scope of the invention described and claimed therein.

What is claimed is:

1. A mold for making castles sections in damp sand, said castles sections having towers, banquettes, parapets and crenelles, said molding comprising:

(a) tower means for forming the walls, banquette and parapets of said towers; said tower means further comprising a tower wall portion having a plurality of spaced apart slots and a tower banquette insert having a plurality of spaced apart grooves in alignment with said slots; and (b) side battlement means for forming side banquettes and parapets adjacent to said towers.

2. The invention of claim 1 wherein said plurality of spaced apart grooves of said tower banquette insert engaged said spaced apart slots of said tower wall portion and the remainder of said tower banquette insert is spaced from said tower wall portion.

3. The invention of claim 2 wherein said tower wall portion is flexible whereby said tower wall portion can be flexed to part said sand from adhesion to said tower wall portion.

4. The invention of claim 2 wherein said wall portion is curved.

5. The invention of claim 2 wherein said wall portion comprises a plurality of sides, each side transverse to an adjacent side, said sides having a cross-section forming a portion of a polygon.

6. The invention of claim 1 wherein said side battlement means comprises at least one side banquette insert engaging said tower means; and at least one side banquette wall engaging said tower means and spaced apart from said side banquette insert.

7. The invention of claim 6 wherein said walls are flexible whereby said sand can be parted from adhesion to said walls.

8. The invention of claim 7 wherein said mold comprises at least one banquette means on opposite sides of said tower means.

9. The invention of claim 6 wherein said mold further comprises flexing means for flexing said side banquette walls.

* * * * *